US007464521B2

(12) United States Patent
Koke et al.

(10) Patent No.: US 7,464,521 B2
(45) Date of Patent: Dec. 16, 2008

(54) VACUUM PACKAGING MACHINE FOR PRODUCT PACKAGES WITH MULTIPLE PRODUCTS

(75) Inventors: John Paul Koke, Duncan, SC (US); Jacob Brinkman, Hamilton (NZ); Ron Whitehead, Hamilton (NZ); David Stevens, Albert Park (AU)

(73) Assignee: Sealed Air Corporation, New Zealand, Hamilton (NZ)

( * ) Notice: Subject to any disclaimer, the term of this patent is extended or adjusted under 35 U.S.C. 154(b) by 0 days.

(21) Appl. No.: 10/540,102

(22) PCT Filed: Dec. 22, 2003

(86) PCT No.: PCT/NZ03/00287

§ 371 (c)(1),
(2), (4) Date: Feb. 27, 2006

(87) PCT Pub. No.: WO2004/056655

PCT Pub. Date: Jul. 8, 2004

(65) Prior Publication Data

US 2006/0272291 A1 Dec. 7, 2006

(30) Foreign Application Priority Data

Dec. 20, 2002 (NZ) ..... 523298

(51) Int. Cl.
*B65B 31/02* (2006.01)

(52) U.S. Cl. ..... 53/510; 53/202; 53/434; 53/512

(58) Field of Classification Search ..... 53/432–434, 53/202, 510, 512
See application file for complete search history.

(56) References Cited

U.S. PATENT DOCUMENTS

| | | | | |
|---|---|---|---|---|
| 3,668,820 | A * | 6/1972 | Parvin et al. | 53/510 |
| 3,673,760 | A * | 7/1972 | Canamero et al. | 53/433 |
| 3,872,644 | A | 3/1975 | Giraudi et al. | |
| 4,457,122 | A | 7/1984 | Atkins et al. | |
| 4,471,599 | A * | 9/1984 | Mugnai | 53/434 |

(Continued)

FOREIGN PATENT DOCUMENTS

DE 3404451 8/1985

(Continued)

OTHER PUBLICATIONS

PCT Search Report for WO 2004/056655 A3 (5 pages).

*Primary Examiner*—Thanh K Truong
(74) *Attorney, Agent, or Firm*—Mark B. Quatt

(57) ABSTRACT

A vacuum packaging machine and a conveyor to deliver a product package from an upstream station to a position adjacent a vacuum chamber. The conveyor has a longitudinal direction defined by the direction of travel of the product package. The vacuum chamber has a heat sealing and cutting assembly oriented transversely to the longitudinal direction of the conveyor and in a position with sufficient spacing between end walls of the vacuum chamber and the assembly for the product package containing two or more products to be loaded into the vacuum chamber with at least one product located in front of the heat sealing and cutting assembly and at least one other product located behind the heat sealing and cutting assembly. The heat sealing and cutting assembly seals and cuts between two products to form two separate evacuated packages.

17 Claims, 18 Drawing Sheets

U.S. PATENT DOCUMENTS

| | | | | | |
|---|---|---|---|---|---|
| 4,777,782 | A | | 10/1988 | Nixon, Jr. et al. | |
| 4,779,398 | A | * | 10/1988 | Glandon et al. | 53/434 |
| 5,105,603 | A | * | 4/1992 | Natterer | 53/412 |
| 5,475,965 | A | * | 12/1995 | Mondini | 53/287 |
| 5,477,660 | A | * | 12/1995 | Smith | 53/433 |
| 5,682,727 | A | | 11/1997 | Harte et al. | |
| 6,877,543 | B2 | | 4/2005 | Stevens | |
| 7,055,297 | B1 | | 6/2006 | Evangelisti et al. | |
| 7,296,390 | B2 | | 11/2007 | Koke et al. | |
| 2001/0011445 | A1 | | 8/2001 | Scolaro | |
| 2002/0083683 | A1 | * | 7/2002 | Suga | 53/432 |
| 2005/0178090 | A1 | | 8/2005 | Koke et al. | |

FOREIGN PATENT DOCUMENTS

| | | |
|---|---|---|
| EP | 1 124 724 B1 | 10/1999 |

* cited by examiner

VACUUM PACKAGING MACHINE FOR PRODUCT PACKAGES WITH MULTIPLE PRODUCTS

This application is a National Stage filing under 35 U.S.C. § 371 of International Application No. PCT/NZ03/00287, which has an international filing date of Dec. 22, 2003, and said International Application claims the benefit of New Zealand patent application serial no. 523298 filed on Dec. 20, 2002.

FIELD OF THE INVENTION

The present invention relates to a vacuum packaging machine for performing a vacuum sealing operation on product packages.

BACKGROUND

Vacuum packaging machines of a known type comprise a vacuum chamber arranged to receive unsealed product packages and operable to perform a vacuum sealing operation on the product packages. Typically the product packages contain products such as meat cuts, arranged in a bag formed by a heat-shrinkable film. After loading and closing the vacuum chamber, the vacuum sealing operation normally comprises vacuumisation, sealing the mouth of the vacuumised bags, and reintroducing air into the chamber. Then the chamber is opened and the vacuum chamber is unloaded. The product packages may then generally be conveyed to a heat-shrinking unit, typically a hot water tunnel, dip tank, hot air tunnel, or other shrink activating system.

In conventional conveyorised chamber systems, the vacuumisation step typically takes at least 20-30 seconds which is significant processing time in the overall packaging process. During this time, the only step which can be taken is to prepare the next product packages for loading into the vacuum chamber, for example by conveying them onto an infeed conveyor. Accordingly, the vacuum packaging machine may cause a bottle-neck in the overall packaging process.

Rotary vacuum packaging machines are known, which comprise a series of vacuum chambers and chain driven product platens. In operation of the machine the platens move from a loading position, thorough a vacuum/sealing/venting stage, to an unloading position, and finally back to the loading position. One disadvantage of these machines is that they have a large footprint, in the order of about 17 $m^2$ for example, and therefore take up a large amount of floor space. A further problem is that these machines generally require manual loading and bag spreading and are thus difficult to incorporate in a fully automated process.

One way of reducing the bottle-neck caused by the vacuum packaging machine is to configure the vacuum packaging machine to heat seal a product package containing two products and cut between the products to form two separated product packages. Such a configuration is described in WO01/56888. This configuration is limited to making pairs of product packages of the same length.

It is an object of at least a preferred embodiment of the present invention to provide a vacuum packaging machine which is suited for use in an automated production line and addresses at least one of the abovementioned disadvantages, or which at least provides the public with a useful choice.

SUMMARY OF THE INVENTION

In accordance with a first aspect of the present invention, there is provided a vacuum packaging machine for performing a vacuum sealing operation on a product package, including or in combination with a conveyor; the conveyor arranged to deliver the product package from an upstream station to a position adjacent a vacuum chamber and having a longitudinal direction defined by the direction of travel of the product package on the conveyor, the vacuum chamber arranged to receive the product package containing two or more products and perform a vacuum, sealing and cutting operation on the product package, the vacuum chamber including a heat sealing and cutting assembly therein which is oriented transversely to the longitudinal direction of the conveyor and which is located in a position in the vacuum chamber such that there is sufficient spacing between end walls of the vacuum chamber and the heat sealing and cutting assembly for the product package containing two or more products to be loaded into the vacuum chamber with at least one product located in front of the heat sealing and cutting assembly and at least one other product located behind the heat sealing and cutting assembly, the heat sealing and cutting assembly arranged to seal and cut across a product package between two products to form two separate evacuated packages.

The heat sealing and cutting assembly preferably includes a pair of heat seal bars. The heat sealing and cutting assembly preferably further includes a pair of heat seal anvils.

The heat sealing and cutting assembly suitably includes a cutting device which is operable to cut the product package between the two heat seals after sealing, to thereby form two separate evacuated packages. The cutting device may comprise a serrated blade. The serrated blade is advantageously operable to initially puncture at least one aperture in the product package, so that as each vacuum sealing operation occurs, air is forced out of the package through the punctured aperture(s) prior to heat sealing.

The heat sealing and cutting assembly may be configured to form two heat seal lines between the two products and then cut between the two heat seal lines to form two separate evacuated packages, following evacuation of the product packages.

The vacuum packaging machine may include an arrangement to clamp the portion of the package to be sealed, prior to sealing and cutting the package. The arrangement to clamp may comprise a spreading system arranged to spread the portion of the package to be sealed. The arrangement to clamp suitably comprises one or more biased pushers which push against the portion of the package to be sealed.

In one embodiment, the vacuum packaging machine includes a puncturing device which is operable to puncture at least one aperture in the portion of the product package adjacent the sealing and cutting assembly so that as the vacuum and sealing operation occurs, air is evacuated from the package through the punctured aperture(s) prior to heat sealing. The puncturing device may comprise one or more piercing knives.

The vacuum packaging machine may be configured to receive, seal and separate a package having at least one open end and containing at least two products into individual product packages, and may include at least one further heat sealing assembly spaced from the heat sealing and cutting assembly configured to seal the open end(s) of the package after evacuation while the heat sealing and cutting assembly carries out the sealing and cutting operation across the product package between two products to form two product packages. In this embodiment, the end heat sealing and cutting assembly and central heat sealing and cutting assembly may be independently operable to perform independent sealing operations, with a conveyor between the two assembles operable to move the package between the two sealing operations, so the lengths of the final product packages can be varied.

The conveyor is suitably configured to deliver the product package(s) directly into the vacuum chamber in the longitudinal direction. The conveyor may have a telescoping portion which is operable to telescope into the vacuum chamber to load each product package into the vacuum chamber and to then retract out of the chamber so that the chamber may be closed to perform the vacuum sealing operation. The vacuum packaging machine preferably includes one or more chamber conveyors for receiving the product package into the vacuum chamber and/or conveying the product package from the vacuum chamber following the vacuum sealing operation. In one embodiment, the vacuum packaging machine includes two chamber conveyors in the vacuum chamber, wherein one of the chamber conveyors is movable from a position spaced from the heat sealing and cutting assembly to a position in which part of the chamber conveyor extends over a lower part of the heat sealing and cutting assembly.

Alternatively, the conveyor may be arranged to deliver the product package to a position alongside the vacuum chamber, and the vacuum packaging machine includes an arrangement to load the product package from the conveyor into the vacuum chamber in a transverse direction. The arrangement to load may include at least one further conveyor configured to load the product package from the conveyor into the vacuum chamber in a transverse direction. The arrangement to load advantageously includes two transverse conveyors in the vacuum chamber to load the product package from the conveyor into the vacuum chamber.

The vacuum packaging machine is preferably indexed to align the portion of each product package between the two products with the heat sealing and cutting assembly. The indexing is suitably adjustable to accommodate product packages containing products of different sizes. The vacuum packaging machine is preferably configured to adjust the operation of one or more conveyors to align the portions of packages containing products of different lengths with the heat sealing and cutting assembly.

A sensor is suitably provided to sense the trailing edge of a leading product and/or the leading edge of the trailing product in the product package on a conveyor.

The vacuum packaging machine may include a further heat sealing and cutting assembly spaced from the heat sealing and cutting assembly, with the heat sealing and cutting assemblies configured to heat seal and cut between at least three products in a product package to form three separate evacuated packages. In this embodiment, the two heat sealing and cutting assemblies may be independently operable to perform independent sealing operations, with a conveyor between the two assemblies operable to move the package between the two sealing operations, so the lengths of the final product packages can be varied.

The vacuum packaging machine may be configured to load a single product package containing two or more products into the vacuum chamber at a time for the vacuum sealing operation.

Alternatively, the vacuum packaging machine may be configured to concurrently load more than one package into the vacuum chamber at a time, the packages being arranged transversely in the vacuum chamber so that they can be vacuum sealed concurrently.

The vacuum packaging machine may further including or be provided in combination with at least one outfeed conveyor operable to convey evacuated product packages from the vacuum packaging machine. The vacuum packaging machine is advantageously configured to load and unload product packages concurrently.

The vacuum packaging machine may have a single vacuum chamber. Alternatively, the vacuum packaging machine may have multiple vacuum chambers.

The vacuum packaging machine may be provided in combination with a wrapping or bagging machine arranged to load at least two products into each product package to be sealed in the vacuum packaging machine. The wrapping or bagging machine is advantageously configured to make or cut the package to a size approximating the size of the products in the package. The wrapping or bagging machine is suitably configured to position the products in the product package with a predetermined spacing.

The wrapping or bagging machine may be programmable to vary the product package size or predetermined spacing.

The wrapping or bagging machine is preferably configured to capture air in the product package when sealing the product package.

In accordance with a second aspect of the present invention, there is provided a method of vacuum sealing a product package, including:

providing a vacuum packaging machine including or in combination with a conveyor configured to deliver product packages from an upstream station to a position adjacent a vacuum chamber and having a longitudinal direction defined by the direction of travel of the product packages on the conveyor; the vacuum chamber including at least one heat sealing and cutting assembly which is oriented transversely to the longitudinal direction of the conveyor;

bringing the product package containing at least two products to a position adjacent the vacuum chamber on the conveyor, the product package oriented with products one behind the other on the conveyor;

loading the product package into the vacuum chamber such that one product is located in front of the sealing and cutting assembly and another product is located behind the sealing and cutting assembly, with the portion of the package between the products located over the sealing and cutting assembly or part of the sealing and cutting assembly; and vacuum sealing and cutting the portion of the product package between the two products to form two separate evacuated packages.

The method may include clamping the portion of the product package between the two products prior to the vacuum sealing and cutting operation.

The method suitably includes puncturing at least one aperture in the product package prior to the vacuum sealing and cutting operation, to enable air to be evacuated from the product package. The vacuum sealing and cutting operation advantageously includes forming two spaced apart heat seals, and cutting between the two heat seals to form the separate evacuated product packages.

The products may be in a package having at least one open end, and the vacuum chamber may include at least one further heat sealing assembly spaced from the heat sealing and cutting assembly and configured to seal the open end(s) of the package after evacuation while the heat sealing and cutting assembly carries out the vacuum sealing and cutting operation across the portion of the package between the two products to form the separate evacuated product packages.

The method may include delivering the product package directly into the vacuum chamber on the conveyor. The conveyor preferably has a telescoping portion which is operable to telescope into the vacuum chamber to load each product package into the vacuum chamber and to then retract out of the chamber so that the chamber may be closed to perform the vacuum sealing operation.

The vacuum packaging machine may include one or more chamber conveyors for receiving the product package into the vacuum chamber and/or conveying the product packages from the vacuum chamber following the vacuum sealing and cutting operation. In one embodiment, the vacuum packaging machine includes two chamber conveyors in the vacuum chamber, wherein one of the chamber conveyors is movable from a position spaced from the heat sealing and cutting assembly to a position in which part of the chamber conveyor extends over a lower part of the heat sealing and cutting assembly.

The conveyor may be arranged to deliver the product package to a position alongside the vacuum chamber, and the method preferably includes loading the product package from the conveyor into the vacuum chamber in a transverse direction. The method may further include unloading the separate evacuated product packages from the vacuum chamber in a transverse direction.

Suitably, the method includes including determining the position of the portion of the product package to be sealed and aligning the portion of the product package to be sealed with the heat sealing and cutting assembly. The method may include detecting the trailing edge of a leading product and/or the leading edge of a trailing product in the product package, and calculating from the speed of a conveyor carrying the product when the conveyor should be stopped to align the portion to be sealed with the heat sealing and cutting assembly.

The method may include adjusting the operation of a conveyor to account for products of different sizes.

The vacuum chamber preferably includes a further heat sealing and cutting assembly spaced from the heat sealing and cutting assembly, and the method may include heat sealing and cutting between at least three products in a product package to form three separate evacuated packages.

The loading operation suitably comprises loading a single product package containing two or more products into the vacuum chamber at a time for the vacuum sealing operation.

The loading operation may comprise concurrently loading more than one package into the vacuum chamber at a time such that the packages are arranged transversely in the vacuum chamber so that they can be vacuum sealed concurrently.

The method preferably includes conveying evacuated product packages from the vacuum chamber on at least one outfeed conveyor. The product package(s) is/are suitably loaded into the vacuum chamber concurrently with the unloading of the evacuated product packages.

The vacuum packaging machine may have a single vacuum chamber. Alternatively, the vacuum packaging machine may have multiple vacuum chambers.

The vacuum packaging machine is advantageously provided in combination with a wrapping or bagging machine, and the method may include loading at least two products into a product package to be sealed in the vacuum packaging machine. The method preferably includes cutting or making the package in the wrapping or bagging machine to a size approximating the size of the products.

The method may include positioning the products in the product package with a predetermined spacing.

The method may include capturing air in the product package when sealing the product package in the wrapping or bagging machine.

The invention consists in the foregoing and also envisages constructions of which the following gives examples only.

BRIEF DESCRIPTION OF THE FIGURES

Preferred embodiments of the present invention will now be described with reference to the accompanying figures, in which.

DETAILED DESCRIPTION OF THE PREFERRED EMBODIMENTS

A form of vacuum packaging machine which is the subject of our New Zealand Patent Application 517488 and PCT Publication No. WO 03/072438 is first described referring to FIGS. 1-13.

Figure 1:
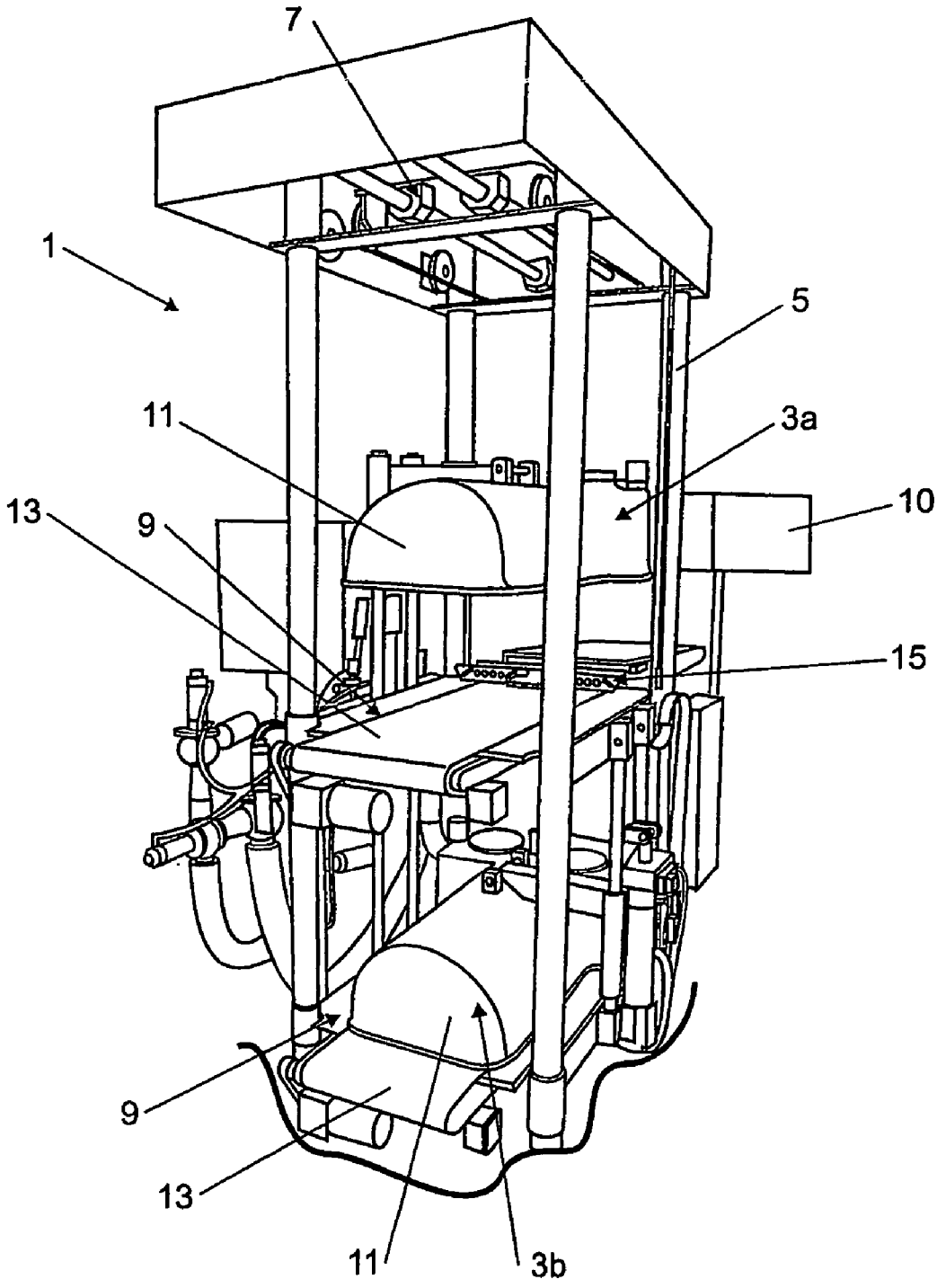
FIG. 1 is an end view of a form of vacuum packaging machine which is the subject of our New Zealand Patent Application 517488.
Figure 2:
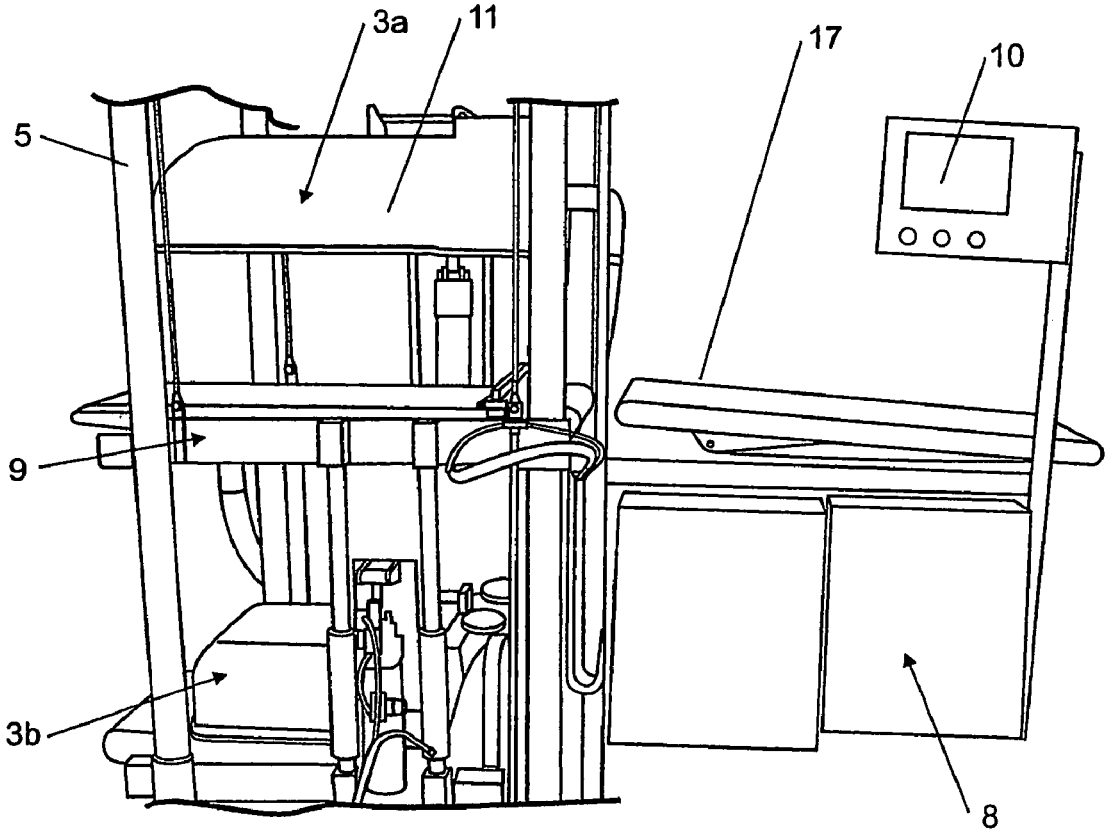
FIG. 2 is a side elevation view of the vacuum packaging machine of FIG. 1.
Figure 3:
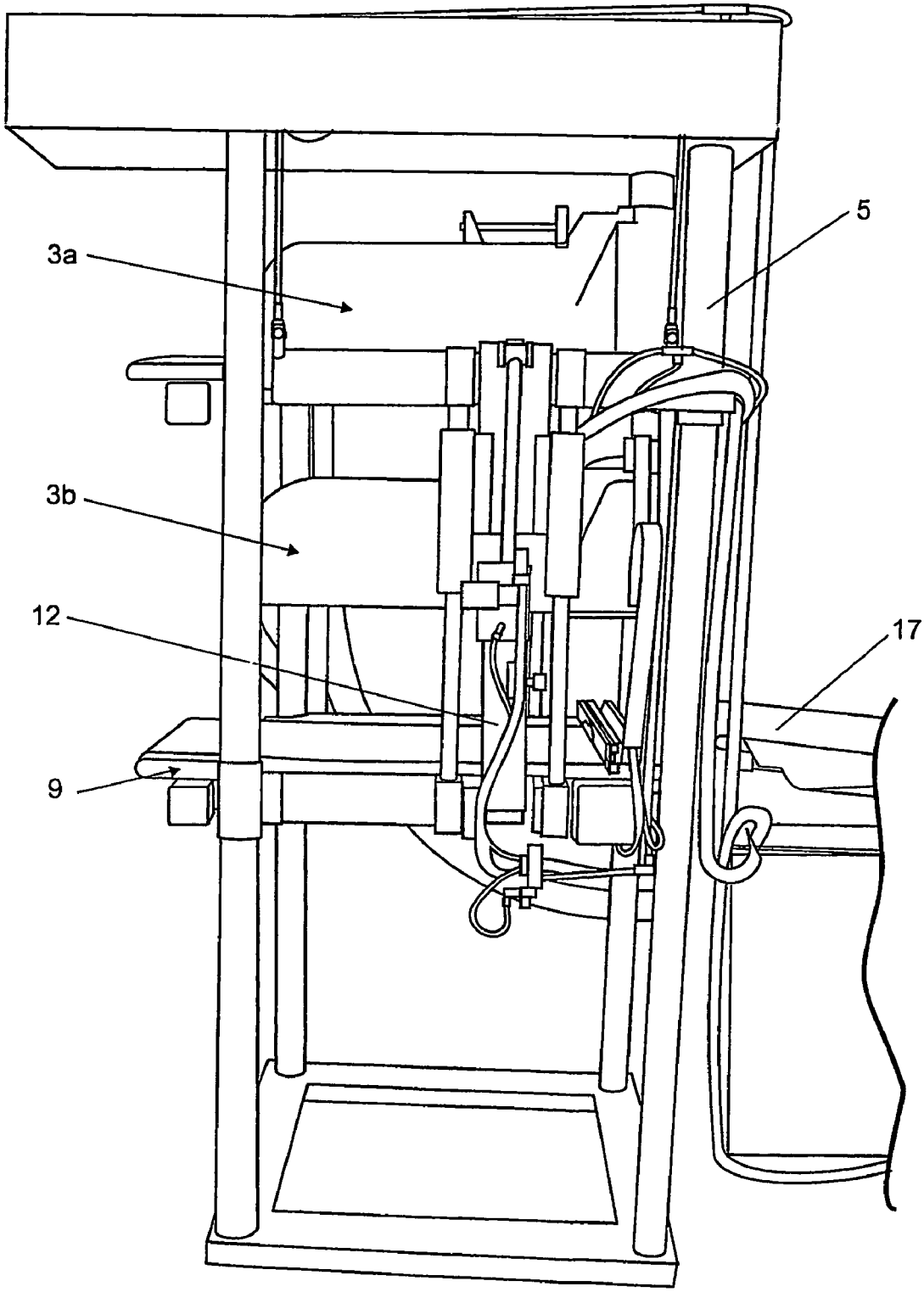
FIG. 3 is a further side elevation view of the vacuum packaging machine of FIG. 1.
Figure 4:
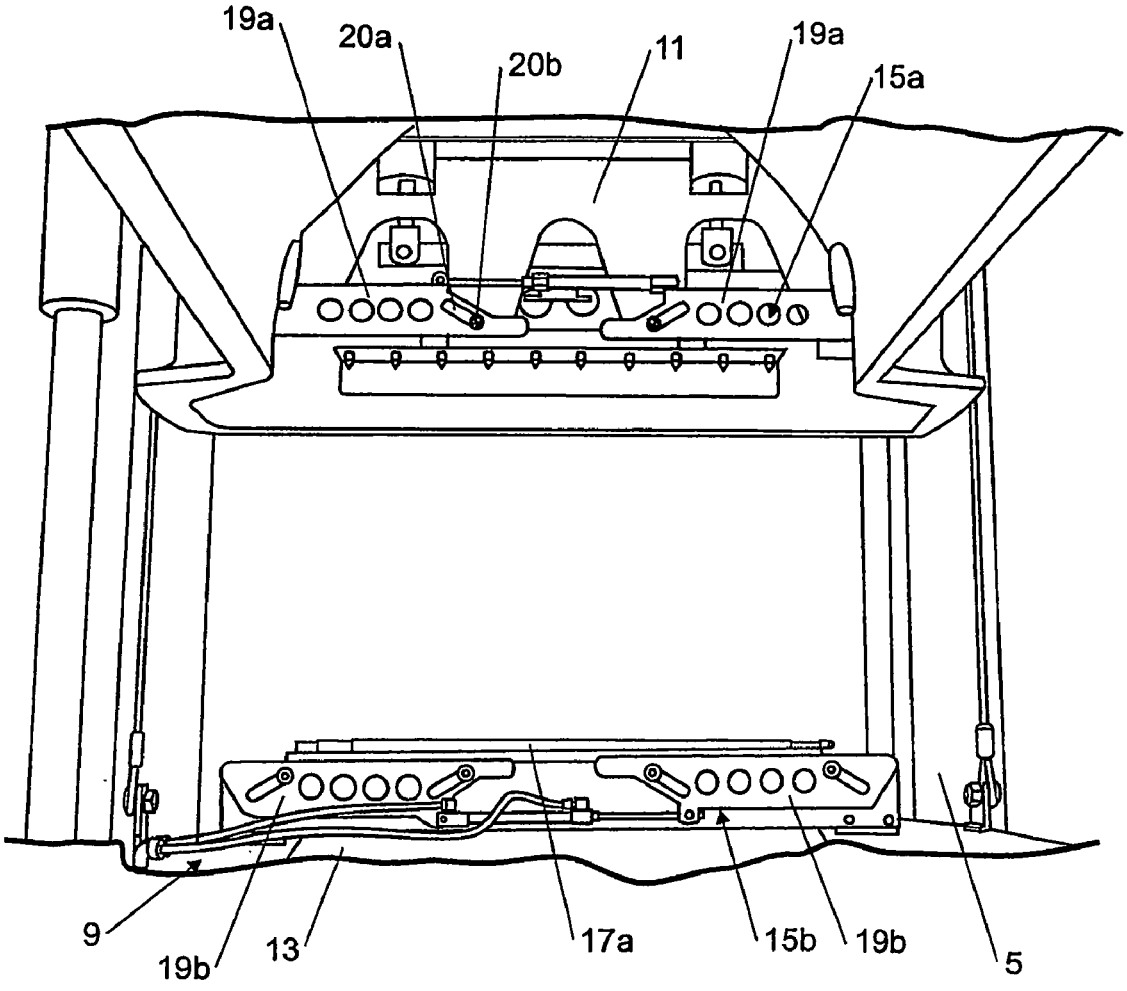
FIG. 4 is a view of the interior of a vacuum chamber, showing a sealing assembly.
Figure 5:
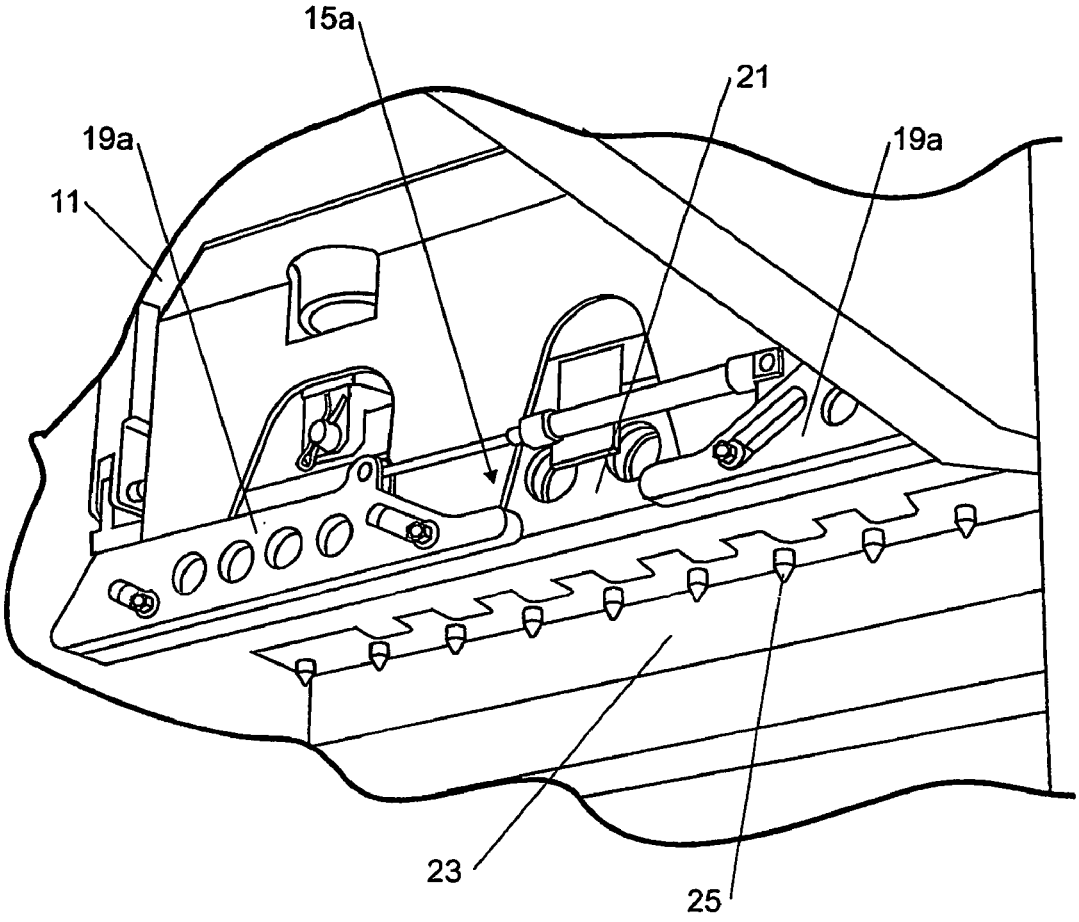
FIG. 5 is a perspective view of the upper interior of a vacuum chamber, showing the details of the upper part of the sealing assembly of FIG. 4.
Figure 6:
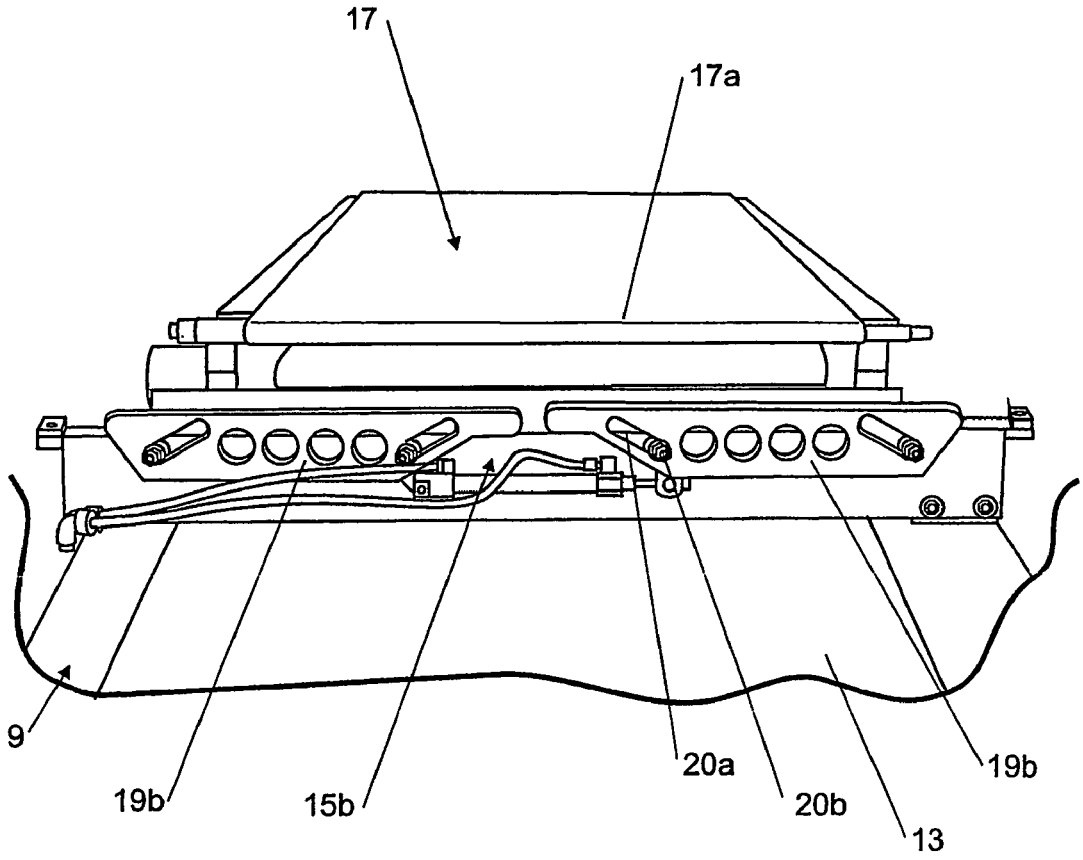
FIG. 6 is a view of the lower part of a vacuum chamber, showing details of a lower part of the sealing assembly of FIG. 4.
Figure 7:
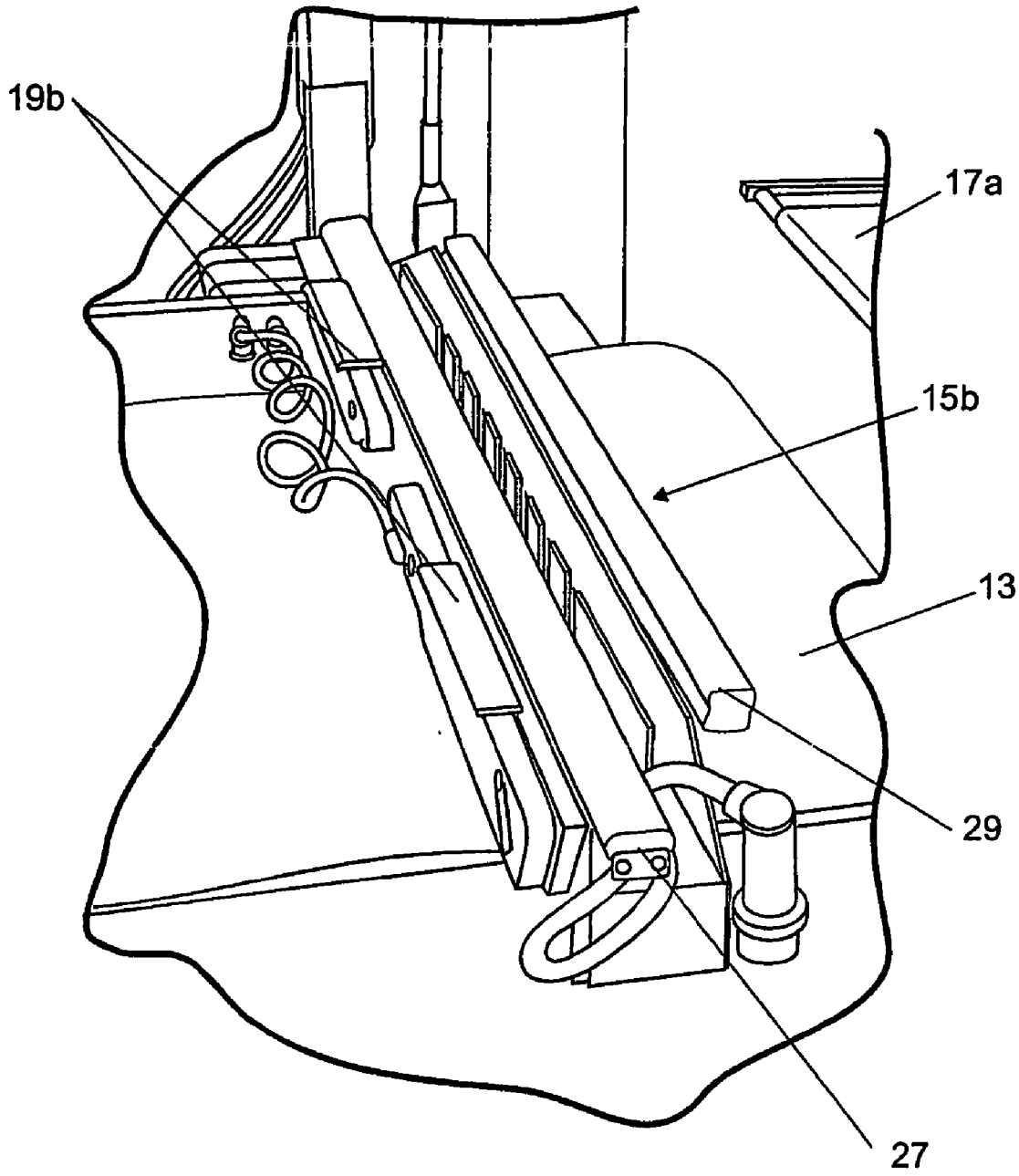
FIG. 7 is a perspective view of the lower part of the sealing assembly of FIG. 4.

With reference to FIGS. 1-3, a preferred embodiment vacuum packaging machine is indicated generally by reference numeral 1. The vacuum packaging machine includes upper and lower vertically stacked vacuum chambers 3*a*,3*b*, which are vertically moveably mounted between columns 5. Mounted adjacent the tops of the columns 5 is a drive mechanism 7 for the vacuum chambers 3*a*, 3*b*, the drive mechanism being described in further detail below with reference to FIGS. 8 and 9.

An electronic control system 8 controls operation of the machine 1, and a keypad/monitor 10 is provided to enable a user to program the control system.

Each vacuum chamber 3*a*, 3*b* includes a bed 9 and a chamber hood 11. The beds 9 are synchronously vertically movably mounted between the columns 5, and each chamber hood 11 is vertically moveable relative to the respective bed 9. The chamber hoods 11 are moved via pneumatic rams 12. Alternative drive means could be used such as hydraulic rams or mechanical means including one or more cams driven by a motor or motors to move the chamber hoods.

Each vacuum chamber has a sealing assembly 15 therein, which will be described in more detail below with reference to FIGS. 4-7. The bed 9 of each vacuum chamber includes a conveyor 13 which operates to position products in the vacuum chamber during loading, and to convey packaged product out of the chamber after it has been vacuum sealed, the direction of travel of the conveyor 13 defining a longitudinal direction of the vacuum chamber.

A conveyor arrangement is provided to load/unload product packages to/from the vacuum chambers. The conveyor arrangement includes an infeed conveyor 17 to load product packages into the vacuum chambers. The operation of the infeed conveyor 17 will be described in further detail below. An outfeed conveyor (not shown) is also provided to remove packaged product from the machine following sealing.

As can be seen from FIGS. 1-3, the vacuum chambers are moveable together between a lower position (shown in FIGS. 1 and 2) wherein the upper chamber 3*a* is adjacent the infeed conveyor 17 for loading/unloading and an upper position (shown in FIG. 3) wherein the bed of the lower chamber 3*b* is adjacent the infeed conveyor 17 for loading/unloading. While one of the vacuum chambers is in the loading/unloading position, the other chamber is in an operating position to perform a vacuum sealing operation on the package(s) contained therein. Therefore, the operating position for the upper vacuum chamber 3*a* is above the level of the infeed conveyor, while the operating position for the lower vacuum chamber 3*b* is below the level of the infeed conveyor.

Having one of the vacuum chambers open for loading/unloading while the other of the vacuum chambers is performing the vacuum sealing operation results in a reduced cycle time over that provided by a conventional vacuum packaging machine.

As can be seen from FIGS. 4-7, the sealing assembly 15 in each vacuum chamber includes an upper part 15*a* and a lower part 15*b*. The sealing assembly 15 extends transversely to the longitudinal direction of the vacuum chamber, and therefore to the direction of travel of product packages through the chamber. This enables the product package to be delivered to the vacuum chamber with its unsealed portion trailing, which is the orientation in which the product package would exit from prior bagging/wrapping stations.

The upper part 15*a* of the sealing assembly includes a pair of upper spreaders 19*a*, a heat sealing anvil 21, a puncturing device having a plurality of piercing knives (not shown), and a clamping device 23 having a series of clamping pins 25. The lower part 15*b* of the sealing assembly includes a pair of lower spreaders 19*b* which are complementary to the pair of upper spreaders 19*a*, a heat sealing bar 27, and a lower clamp bar 29.

In this particular embodiment, the spreading operation is as follows. The spreaders 19*a*, 19*b* are operable to grip and spread the unsealed part of the product package prior to heat sealing. As will be apparent from the Figures, as the upper 19*a* and lower 19*b* spreaders are brought together, they move outwardly by virtue of the angled slots 20*a* and pins 20*b* extending therethrough. The spreaders function in a similar way to those described in PCT Publication No. WO 02/10019, the disclosure of that publication being incorporated herein by reference, and will not be described further here.

Alternative spreading systems are also envisaged. In one alternative, an air "curtain" provided by a series of small air jets will be provided to blow the unsealed package neck flat over the seal bar.

A further embodiment would be to restrict the air flow out of the product package during the vacuuming process and to use the resulting back pressure created to spread the neck of the package over the heat seal bar. This restriction may take the form of a bar spaced a fixed distance above the heat seal bar or alternatively a lightly spring-loaded or gravity bar.

These embodiments are examples only, and other automatic spreading systems are envisaged.

The clamping pins 25 and lower clamp bar 29 (which would generally be made from a resilient material such as rubber) maintain the unsealed portion of the package in the spread configuration, and provide tension on the product package such that it can be pierced. When the puncturing device is actuated, the knives (not shown) pierce the package. The puncturing device forms small apertures in the product package. During loading of the product package into the vacuum chamber, it is feasible that the trailing unsealed portion of the package may be located such that it will be clamped under the end wall of the vacuum chamber hood 11 when it is closed. The apertures formed by the puncturing device ensure that any air in the product package may still be evacuated if this should occur.

The heat seal anvil 21 is operable to push against the heat seal bar 27 with the unsealed portion of the product package therebetween, applying a current to the heat seal bar and sealing the product package.

Although not shown in the Figures, a cutting device will be provided to cut the product package between the heat seal bar 27 and the puncturing device. The preferred cutting device is a serrated knife, which is arranged to move downwards from above to shear the product package.

Although not shown in the Figures, the machine includes a scrap removal device to remove the cut-off portions of the product package from the machine. The preferred scrap removal device comprises a "push-pull" system. A series of air jets are provided on the top front face of the heat seal bar. After the unused product package neck has been cut and the chamber opens, the cut portion of the neck will be supported on the clamping bar 29. When the chamber opens this clamping bar will drop down to its home position while the air jets are simultaneously activated. This action will blow the severed bag neck toward a suction system which is mounted below the nose roller of the telescoping infeed conveyor 17. Advantageously, a second set of air jets may also be provided along the bottom of the heat seal bar, just above the chamber conveyor 13, to create a full air curtain blowing toward the suction system. A significant advantage of this product loading/chamber system is the relatively small distance between the air jet and the suction system (approximately 100 mm). In a conventional rotary system the scrap has to be blown transversely across a gap of approximately 600 mm. Other means of removing scrap could be provided.

The belt of the conveyor 13 extends under the lower part of the sealing assembly 15*b*, and around the outer ends of the bed 9 of the vacuum chamber. For this purpose, the undersurface of the conveyor belt comprises a smooth surface (relative to a conventional cloth surface), for example a smooth plasticised surface, such that the vacuum chamber can seal over the belt.

In order to deliver the product package over the lower part 15*b* of the sealing assembly, the infeed conveyor has a telescoping portion 17*a*. During loading of an open vacuum chamber, the telescoping portion 17*a* extends over the lower part 15*b* of the sealing assembly, and is operated to drop the body of the product package onto the conveyor 13 on the bed 9 of the vacuum chamber. The trailing unsealed portion of the packaged product will remain located on the telescoping portion 17*a* of the infeed conveyor. As the telescoping portion 17*a* is retracted away from the vacuum chamber so that the vacuum chamber can be moved and closed, the trailing unsealed portion of the product package will drop onto the lower part 15*b* of the sealing assembly, so that the unsealed portion can be spread and sealed. The sealing assembly 15 is relatively low profile to minimise the product drop distance as the telescoping portion 17*a* of the conveyor is extended into the vacuum chamber.

Figure 8:
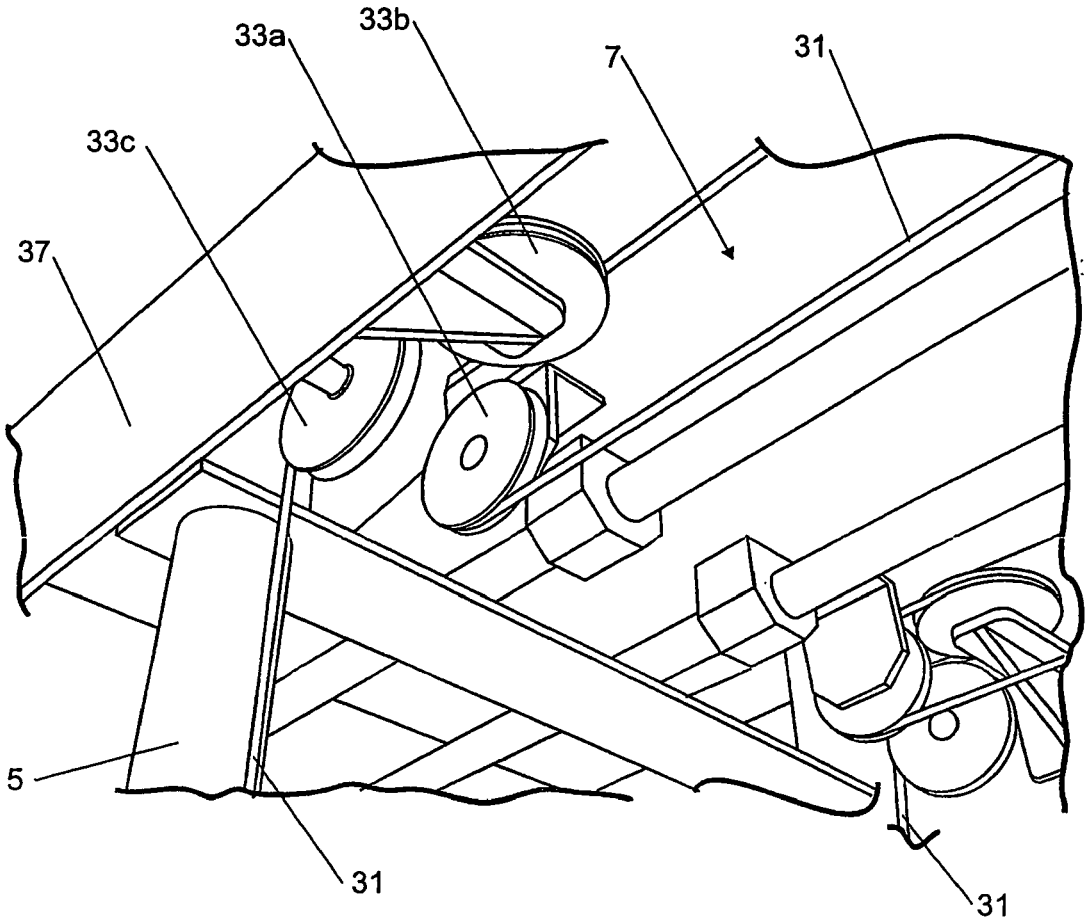
FIG. 8 shows part of a pulley arrangement for raising and lowering the vacuum chambers in the machine of FIG. 1.
Figure 9:
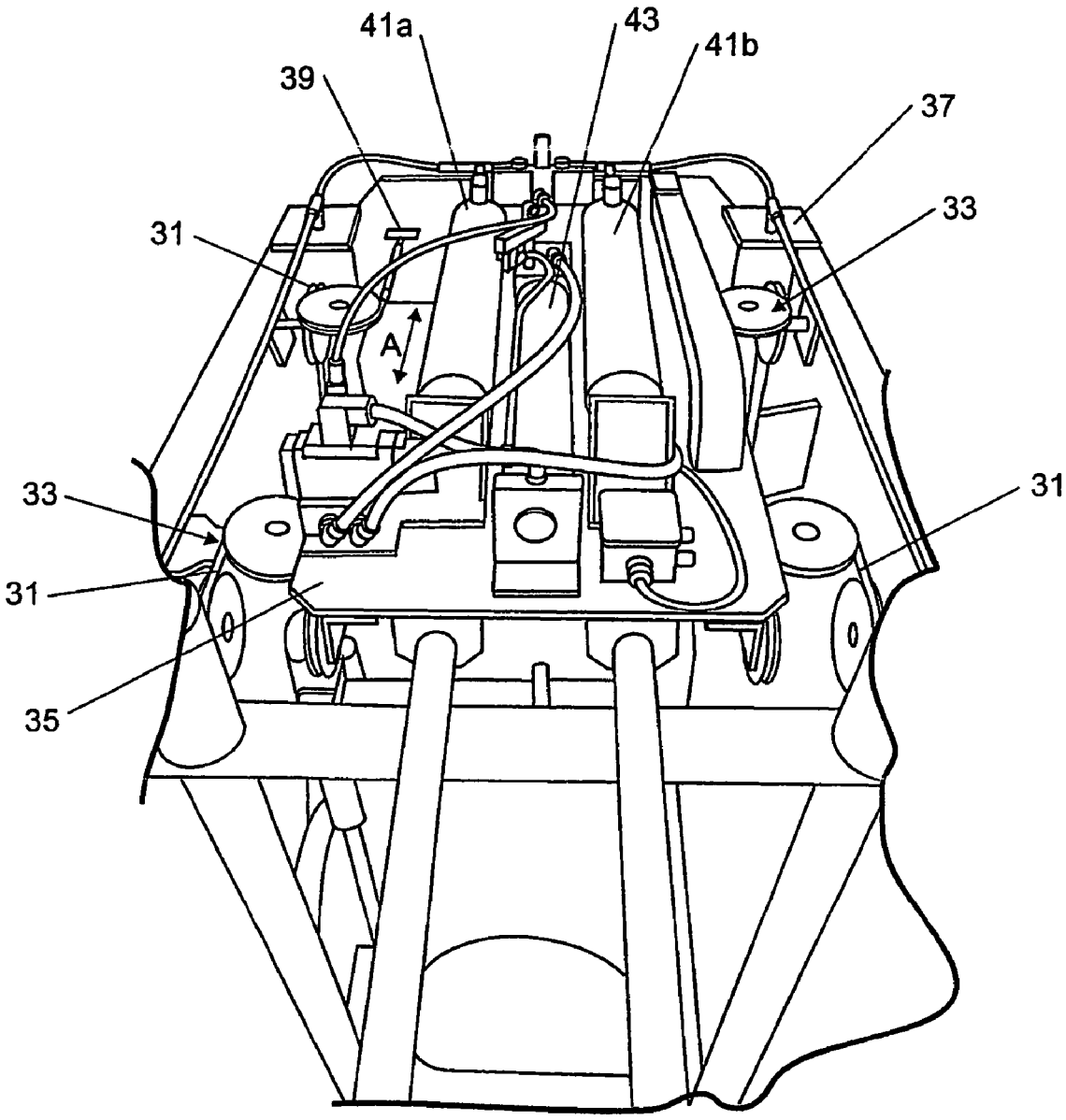
FIG. 9 is an overhead end view of the machine of FIG. 1.

In this embodiment, the vertical position of the vacuum chambers is adjusted by means of a drive mechanism 7 comprising a cable and pulley system as shown in FIGS. 8 and 9. The vacuum chambers are suspended by four cables 31 which extend downwardly to the vacuum chamber beds 9 adjacent each column 5 of the machine, not all of the cables being visible in the Figures. A triple arrangement of pulleys 33 is provided adjacent each corner of the machine. A main drive bed 35 is drivable in a horizontal plane as indicated by Arrow A in FIG. 9, and at each corner one pulley 33*a* is rotatably attached to the main drive bed 35, while the other two pulleys 33*b*, 33*c* are rotatably attached to a stationary framework 37. One end of each cable 31 is operably attached to the vacuum chamber beds 9, while the other end of each cable is attached to the framework 37 as indicated by reference numeral 39.

By virtue of the above configuration of pulleys and cables, horizontal movement of the drive bed 35 results in synchronized raising or lowering of the vacuum chamber beds 9. The pulley configuration is such that horizontal movement of the drive bed 35 results in a vertical movement of the vacuum chambers of double the magnitude. For example, a top stroke of the drive bed 35 of 400 mm results in a vertical movement of the vacuum chambers of 800 mm. However, this 2:1 ratio of vacuum chamber movement versus drive bed movement requires twice the power that would be required for a 1:1 ratio.

To compensate for this, two constant pressure cylinders 41*a*, 41*b* are provided to counterbalance the weight of the vacuum chambers. The constant pressure cylinders may be hydraulic cylinders, but in this preferred embodiment are pneumatic cylinders. These cylinders 41*a*, 41*b* are isolated with their own pressure vessels, which in this embodiment are the vertical columns 5 of the machine. The cylinders 41*a*, 41*b* hold the vacuum chambers in equilibrium, meaning that a lesser amount of force is required to vertically move the vacuum chambers than would otherwise be required.

A further cylinder 43 drives the bed 35 movement and thereby the vertical movement of the vacuum chambers 3*a*, 3*b*. By virtue of the constant pressure cylinders 41*a*, 41*b* counterbalancing the weight of the vacuum cylinders, only 14% of the compressed air which would otherwise be required to vertically move the vacuum chambers is needed, resulting in energy savings. More importantly, as the two cylinders 41*a*, 41*b* which counterbalance the weight of the pressure vessels are isolated with their own pressure vessels 5, in the event of mechanical failure or sudden loss of air supply, the vacuum chambers 3*a*, 3*b* will not crash down, resulting in improved safety.

Figure 13:
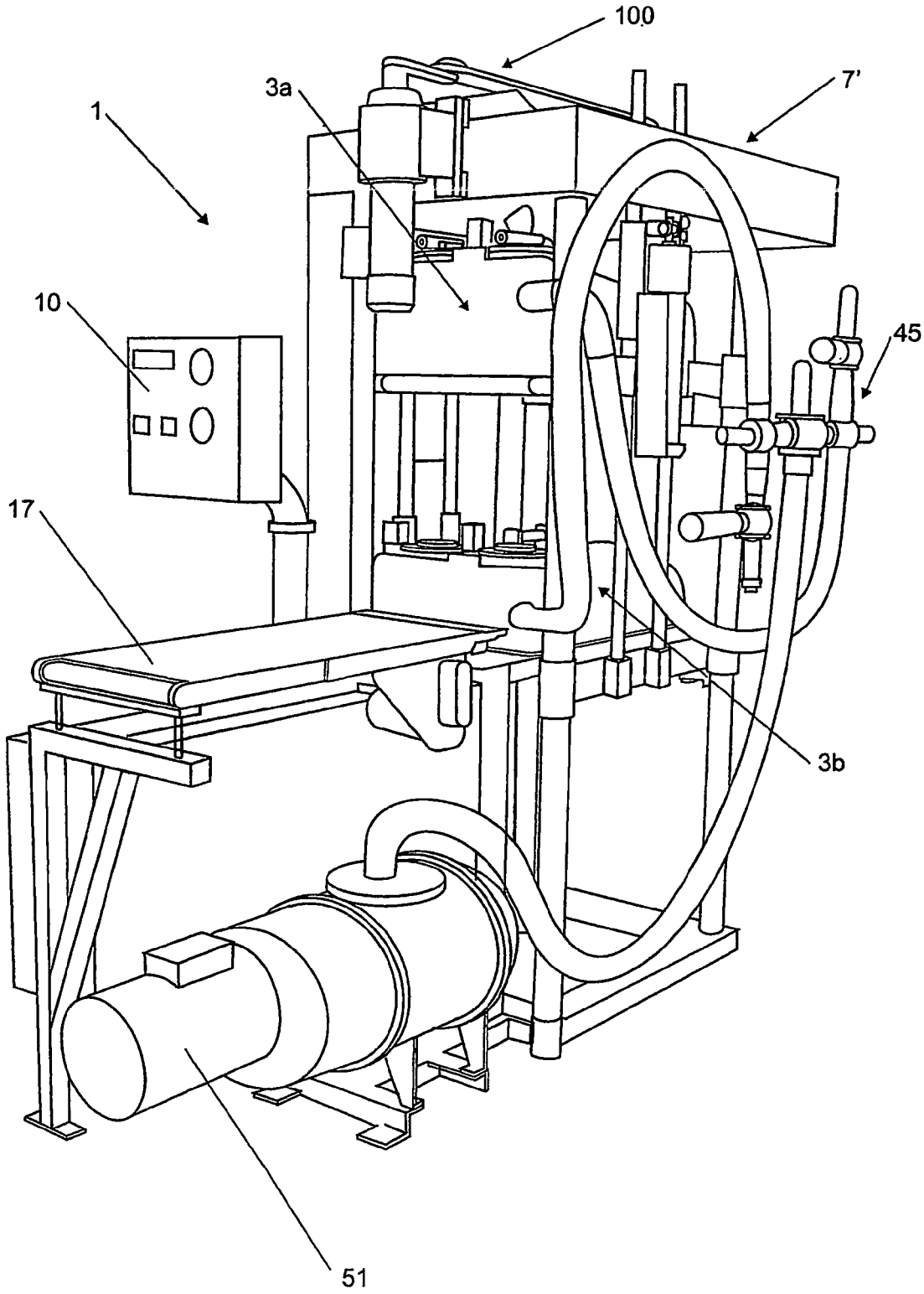
FIG. 13 is a perspective view of another embodiment of vacuum packaging machine which is the subject of our New Zealand Patent Application 517488.

In an alternative embodiment, the vacuum chambers may be raised and lowered by a crank 100, as shown generally in FIG. 13. In this embodiment the drive bed 35 is moved by a 180° turn of the crank arm. In this embodiment, if the crank arm is 200 mm long, and this arm is linked to the drive bed 35, rotating the arm by 180° will move the bed 400 mm, which in turn will move the vacuum chambers 800 mm. This crank system has the additional advantage of moving the chambers slowly as the crank moves off its 0° position, ramping to a maximum speed as the crank moves through the 90° position, and decelerating to a stop as the crank moves to the 180° position. The net result is that a very smooth chamber motion is provided, with a highly accurate end stop positioning.

Figure 10:
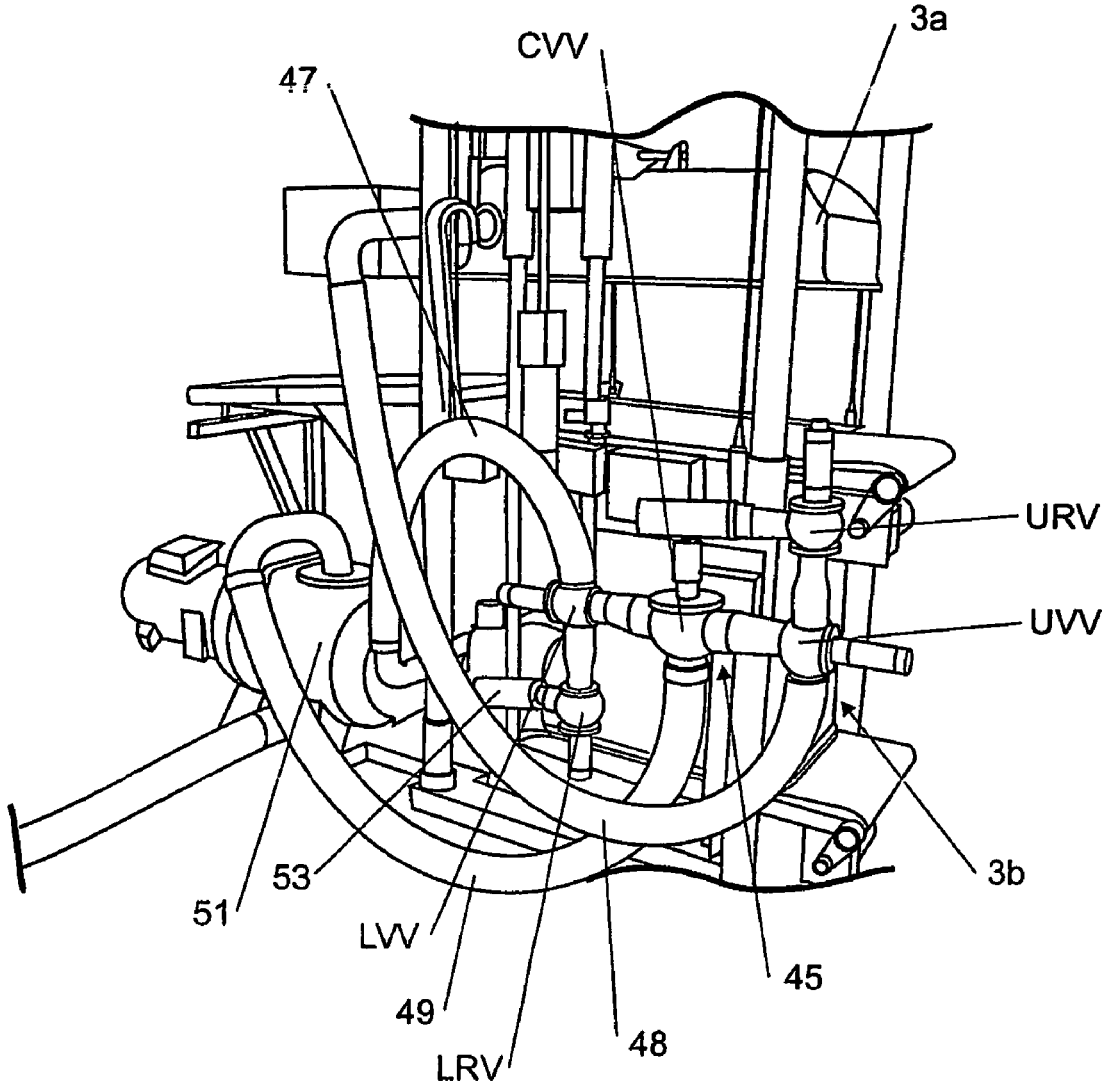
FIG. 10 is a side elevation view of the machine of FIG. 1, showing a cross-flow valve mechanism for transferring vacuum between vacuum chambers.
Figure 11:
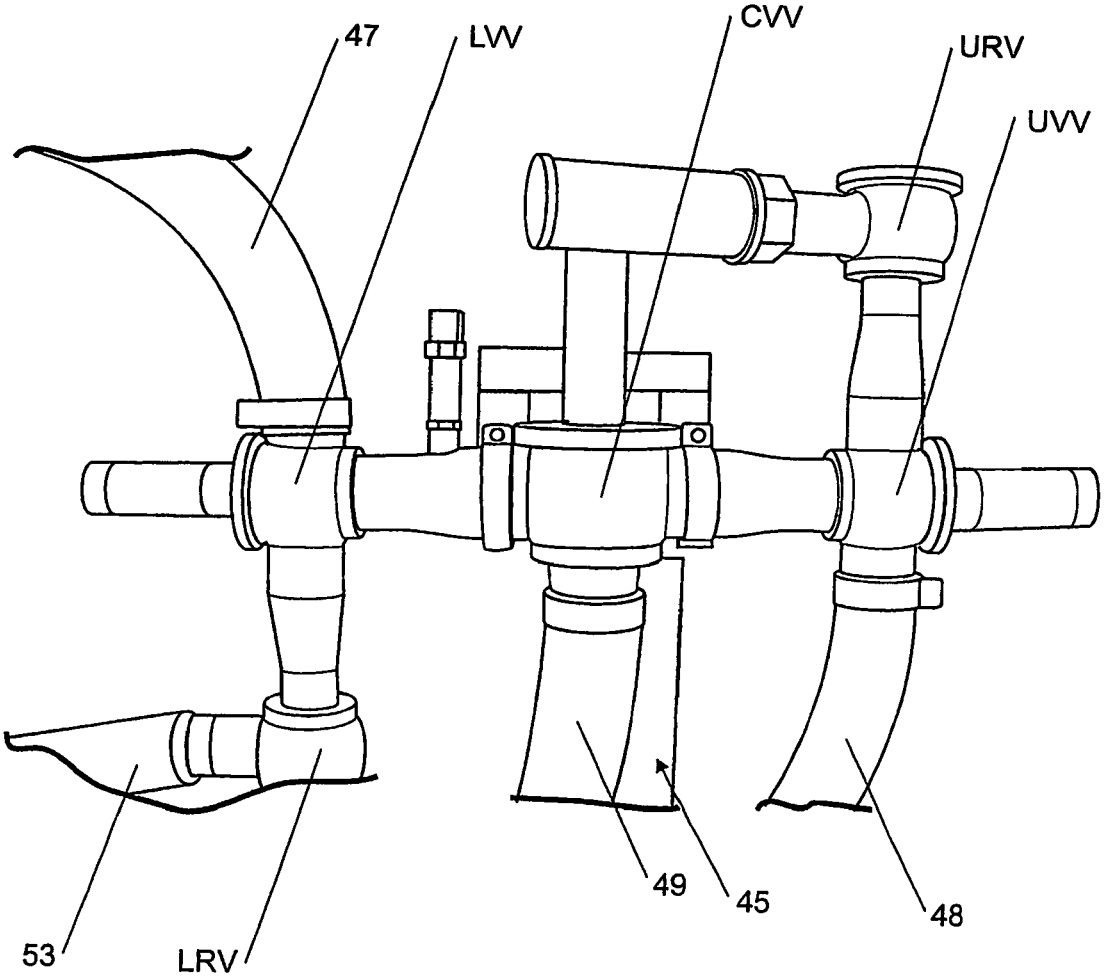
FIG. 11 is a further detailed view of the cross-flow valve mechanism of FIG. 10.
Figure 12:
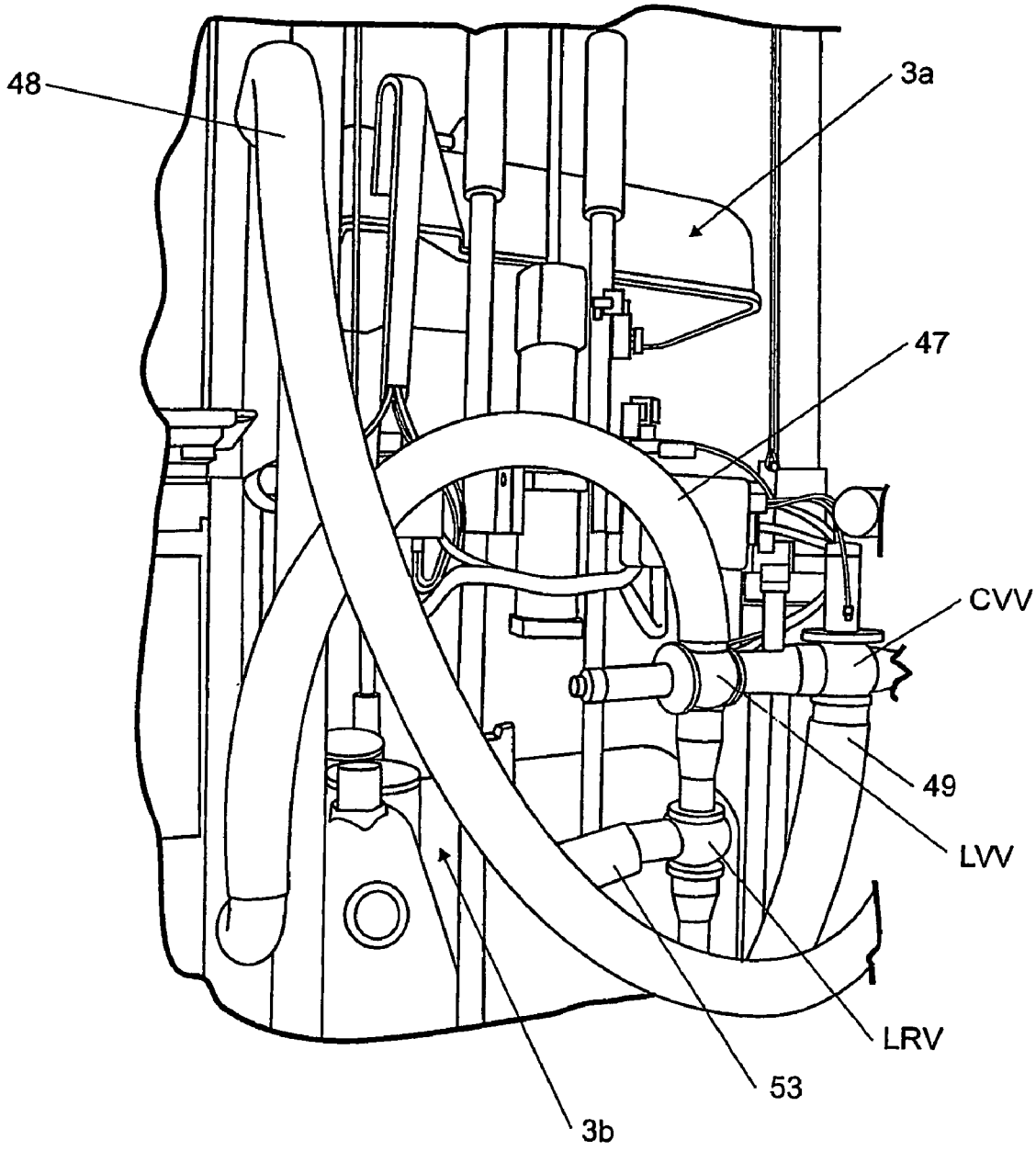
FIG. 12 is a further detailed view of the cross-flow valve mechanism of FIGS. 9 and 10.

The vacuum packaging machine includes a cross-flow valve mechanism as indicated generally by reference numeral 45 in FIGS. 10-12. The purpose of the cross-flow valve mechanism is to transfer pressure from a recently-loaded vacuum chamber to a recently-evacuated vacuum chamber.

For the purpose of explanation, presume that the lower vacuum chamber 3*b* is being evacuated. Valve LRV is closed. Air from the lower vacuum chamber 3*b* travels through tube 47, through open valves LVV and CVV, and out through tube 49 through a blower 51. Once the lower vacuum chamber 3*b* has been fully evacuated, valve CVV is closed and valve LVV is maintained in the open configuration, the vacuum thereby being held in the tube 47.

Simultaneously, the upper vacuum chamber 3*a* has been loaded, and once loading is completed, can be closed. Once the upper vacuum chamber has been closed, valve UVV is opened, meaning that pressure will equalize between the upper and lower vacuum chambers through tubes 47 and 48. ½ atmosphere pressure will have transferred to the lower vacuum chamber 3*b*, both of the vacuum chambers thereby being at ½ atmosphere pressure. Then valve LVV is closed, and valve LRV is opened, causing ½ atmosphere pressure to be sucked into the lower vacuum chamber 3*b* through a silencer 53. Simultaneously, valve CVV is opened to allow the vacuumisation process to be completed on the upper chamber.

By this time, the lower vacuum chamber will have been moved back to the loading/unloading position and will be at atmospheric pressure. Valve LVV can then be closed as the lower vacuum chamber is opened to unload the packaged product therefrom and load a new unsealed product package. The process then repeats.

An advantage of utilizing the cross-flow valve mechanism to transfer the vacuum is that only ½ atmosphere of pressure needs to be removed from a vacuum chamber during an evacuation by the pump 51, resulting in significant cycle time reductions.

As mentioned above, the chamber hoods 11 are moved via pneumatic rams 12. Once the vacuum sealing has occurred in a vacuum chamber, and ½ atmosphere pressure has been transferred to the evacuated chamber, an opening force is applied by the rams 12. Once the vacuum is removed from the chamber, the vacuum hood opens under force.

Method of Operation

The vacuum packaging machine 1 would generally be located downstream from a manual, semi-automatic, or fully automatic bagging machine. A fixed input conveyor (not shown) would deliver unsealed product packages to the infeed conveyor 17, the packages being oriented such that the unsealed portion of each package is trailing.

For the purpose of explanation, presume that the lower vacuum chamber 3*b* is in the lower operative position and is presently vacuum sealing a product package therein, and the upper vacuum chamber 3*a* is open and adjacent the infeed conveyor 17, ready for loading.

The infeed conveyor 17 is actuated such that the telescoping portion 17*a* extends over the sealing assembly 15 and is operated to place a product package onto the moving conveyor 13 on the bed of the vacuum chamber 3*a* As the telescoping portion 17*a* of the infeed conveyor 17 is retracted from within the vacuum chamber, the trailing unsealed portion of the product package falls onto the sealing assembly. The telescoping conveyor is equipped with a sensing means to detect the trailing edge of the product and place it just in front of the sealing assembly 15. In a preferred embodiment, the detecting means is a capacitive sensor mounted in the bed of the telescoping conveyor 17.

The hood 11 of the upper vacuum chamber 3*a* can then be closed and ½ atmosphere pressure is transferred to the recently evacuated lower vacuum chamber as described above with reference to FIGS. 10-12. The chambers will move to their upper positions, and the remaining air will be evacuated from the lower chamber 3*b*, the chamber then being opened and the packaged product unloaded while the new product package is simultaneously loaded.

In the upper vacuum chamber 3*a*, the unsealed portion of the product package is spread by the spreading system. The puncturing device is then actuated, such that knives pierce the unsealed portion of the product package while the clamping pins 25 hold it in the spread configuration against the clamp stop 29. The spreader bars 19 are then released, and the vacuum chamber 3*a* is evacuated, through the cross-over and vacuum techniques previously described, thereby evacuating any air from the product package through its unsealed portion and/or the pierced apertures.

The heat seal anvil 21 then pushes against the heat seal bar 27, heat sealing the package therebetween. The cutting device then shears the scrap portion of the product package between the heat seal bar 27 and the puncturing device. The anvil 21 is then moved away from the heat seal bar 27. When the chamber moves to the loading/unloading position and opens, the packaged product and the scrap cut-off portion of the package will be released. The air curtain and suction are then actuated to remove the scrap from the vacuum chamber.

In the meantime, the lower vacuum chamber 3*b* will have already been loaded with a further unsealed product package, and ½ atmosphere pressure is again transferred between the vacuum chambers as described above. The cycle repeats, with the vacuum chambers moving to their lower positions such that the lower chamber is in the operative position and the upper chamber is in the loading/unloading position.

The preferred embodiment machine described above has a number of advantages:

By utilizing a transversely mounted sealing assembly and heat sealing bar, the product packages can be fully automatically loaded and heat sealed in the orientation in which they exit a standard bagging, wrapping, sorting machine, enabling the machines to be utilized as part of a fully automated in-line process.

By virtue of having vertically stacked vacuum chambers, the preferred vacuum packaging machines have a footprint of about 1-3 $m^2$ as opposed to 17 $m^2$ for a standard rotary machine.

The parallel system which enables one vacuum chamber to be loaded/unloaded while the other vacuum chamber performs a vacuum sealing operation results in a reduced cycle time.

The preferred machines provide cycle time savings by virtue of the transfer of pressure between the recently-loaded vacuum chamber and the recently-evacuated vacuum chamber, using the cross-flow valve mechanism.

In another preferred embodiment, the vacuum chambers are cantilevered off a rail system. Built into the rail system is a constant pressure cylinder to counter balance the weight of the vacuum chambers. The beds of the vacuum chambers are suitably movable by way of pneumatic cylinders of chain or a cam activated motor system.

Preferred Embodiment of Vacuum Packaging Machine of the Invention

Figure 14:
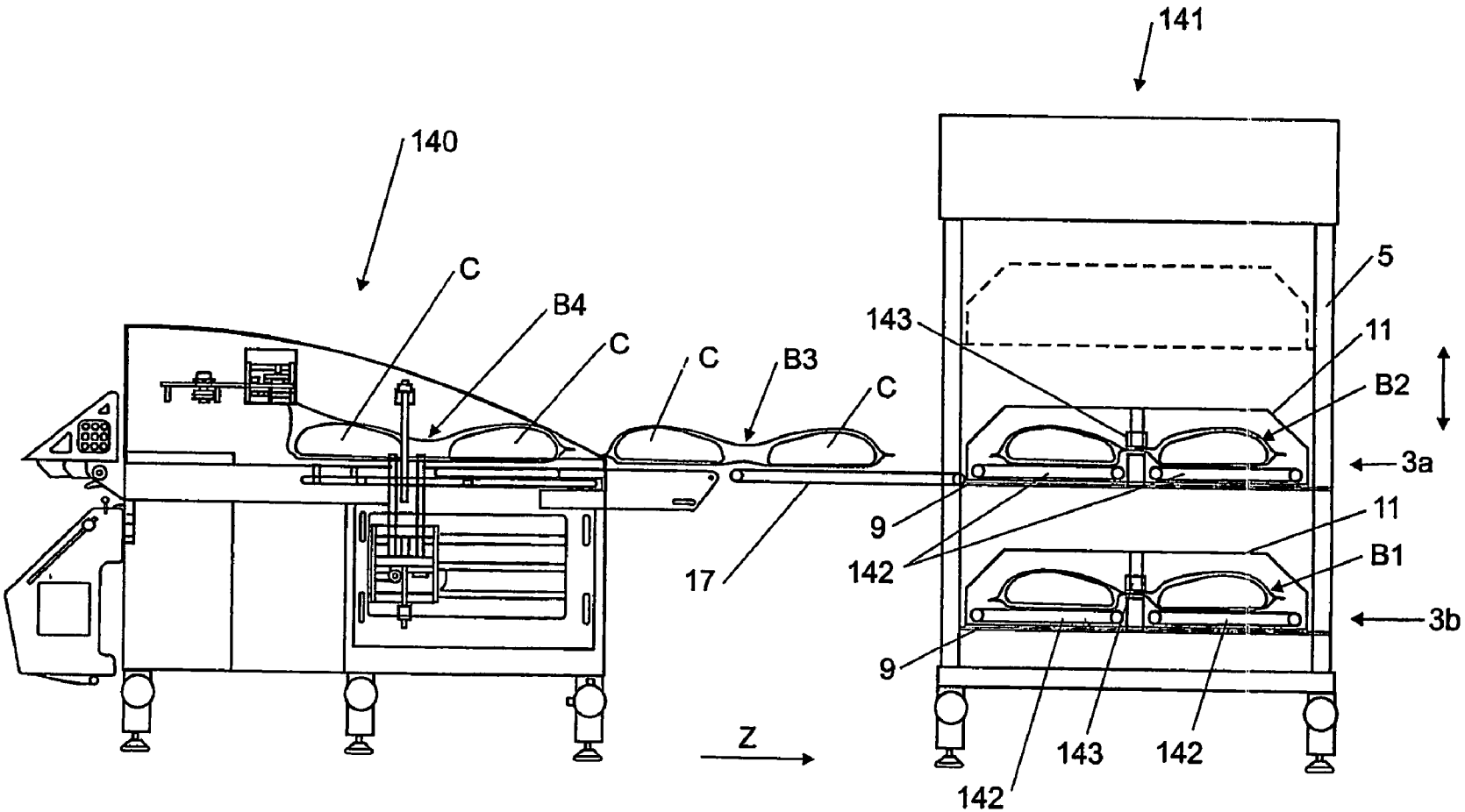
FIG. 14 is a schematic diagram of a preferred embodiment of a vacuum packaging machine of the subject invention.

FIG. 14 schematically illustrates a preferred embodiment of the vacuum packaging machine of the invention. The operation of the machine is generally similar to the machine of FIGS. 1-13 and unless indicated otherwise it should be understood that the detailed structure and componentry and operation of the preferred embodiment machine of FIG. 14 is similar to that of the machines of FIGS. 1-13. The machine preferably comprises upper and lower vertically stacked vacuum chambers 3*a* and 3*b*, which as before are vertically moveably mounted between columns 5, and mounted adjacent the tops of the columns 5 is a drive mechanism (not shown in detail in FIG. 14) similar to that of FIGS. 8 and 9. Again an electronic control system controls operation of the machine and a keypad/monitor may be provided to enable a user to program the control system.

Each vacuum chamber 3*a*, 3*b* includes a bed 9 and a chamber hood 11. The beds 9 are synchronously vertically moveably mounted between the columns 5, and each chamber hood 11 is vertically moveable relative to the respective bed 9, again by pneumatic rams for example. An infeed conveyor 17 delivers product packages to the vacuum chambers, from a wrap and seal machine 140 as will be described, and an outfeed conveyor (not shown) is also provided to convey the packaged products from the machine following sealing.

Operation of the machine is broadly similar to operation of the machines of FIGS. 1-13. The infeed conveyor 17 delivers product to one or other of the vacuum chambers when in the centre position and open (vacuum hood raised). Either the infeed conveyor then loads the product into the chamber, or another conveyor is used to load the product into the chamber from the infeed conveyor. The hood of the vacuum chamber into which the unevacuated package has been delivered then closes and the vacuum chamber moves upwardly or downwardly to the upper or lower position and evacuation and sealing of the package is carried out while the chamber is in this position, while the other vacuum chamber which has moved upwardly or downwardly to the centre position is opened and vacuumed and sealed packages removed via the outfeed conveyor.

However, the vacuum packaging machine of the invention is arranged to receive packages containing two or more products per package, as shown.

In one arrangement, products may enter the wrapping and sealing machine 140 prior to being carried by the infeed conveyor 17 to the vacuum packaging machine. In the wrapping and packaging machine products such as again meat cuts C are moved on to a length of flat packaging material which is then wrapped over the meat cuts, heat sealed across the forward end of the package, the machine forms a longitudinal seal along the length of the package, and heat seals the trailing end of the package. The wrapped and sealed package containing the two meat cuts exits the wrapping and packaging machine and is carried by the infeed conveyor 17 to a position adjacent the vacuum chamber. The wrapped and sealed package is then entered into an open vacuum chamber. In the preferred form the vacuum chambers include chamber conveyors 142 on the bed of the vacuum chambers as shown, which operate with the infeed conveyor 17 to carry arriving packages into and position them in the vacuum chambers, before the vacuum hood closes at the commencement of the evacuating and sealing operation. Possible arrangements of conveyors for delivering packages into, and positioning them in, the vacuum chambers are shown in FIGS. 15 to 18 and described further below.

A sealing and cutting assembly 143 is positioned in each vacuum chamber such that there is sufficient spacing between end walls of the vacuum chamber and the sealing and cutting assembly for a product package containing two products to be loaded into the vacuum chamber with one product located in front of the sealing and cutting assembly and the other product located behind the sealing and cutting assembly. In the embodiment shown, the sealing and cutting assembly 143 is mounted generally centrally within each vacuum chamber. The sealing and cutting assembly 143 is arranged to seal and cut between the two meat cut products in each package after evacuation, to form two separate evacuated packages each containing a single meat cut, which then exit the machine. In a preferred form each sealing and cutting assembly 143 comprises two heat seal bars which are arranged to form two generally parallel heat seals transversely across the package between the two products, and a blade or similar between the two heat seal bars which is arranged to cut between the two heat seals to form two separate packages.

For example, the upper part of each sealing and cutting assembly 143 may include a pair of upper spreaders, a heat sealing anvil, a puncturing device having a plurality of piercing knives, and a clamping device similar to that described for the machine of FIGS. 1-13. The lower part of each sealing and cutting assembly 143 may include a pair of lower spreaders which are complementary to the upper spreaders, heat sealing bars, and a lower clamp bar. Operation of the spreaders, heat sealing bars, and cutting and clamping device is similar to that for the machine of FIGS. 1-13 except that the heat sealing and cutting is carried out across the package to form two separate evacuated packages. The spreader may operate more effectively in a machine in which the packages are sealed and contain trapped air when loaded into the machine (with the packages being punctured before evacuation) as the trapped air may assist in forcing any pleats or wrinkles out as the spreaders operate.

Rather than using a wrapping machine as shown, the products may be loaded into a bag in a bagging machine, and the bagging machine may be configured to seal the open end of the bag containing the two products prior to delivery to the vacuum packaging machine. In an alternative configuration the two meat cuts or products instead of passing through a wrapping and sealing stage 140 before entering the vacuum packaging machine may be placed within a single long bag formed from tubular material sealed at one end, or a tube not sealed at either end. The bag or tube containing the two products is entered into a vacuum chamber containing an additional heat sealing mechanism at one end as in the machine of FIGS. 1-13, or heat sealing mechanisms at either end, as well as the central sealing and cutting mechanism 143, so that after evacuation the bag is sealed at its open end, or a tube is sealed at both ends, as well as being sealed and severed centrally. With this arrangement no puncturing mechanism would be required to be associated with the sealing and cutting assembly 143. The bagging machine could be configured to load the products into pre-made bags.

In the embodiments in which the product package is sealed in the wrapping or bagging machine prior to delivery to the vacuum packaging machine, it is preferred that air is captured in the package around the products. That way, when the product is heat sealed in the vacuum packaging machine, such as when the heat seal bars and anvils are pushed together to hold the product package, the package will balloon against the heat seal bars and anvils. That will reduce any pleats or folds in the portion of the package to be heat sealed, thereby improving the final seal integrity.

It is preferred that the wrapping and sealing machine 140 or the bagging machine are configured to size the wrapping or bag to a length approximating the size of the two products to be packaged, to minimise waste. This can be achieved by providing a sensor on a conveyor for the wrapping and sealing machine or bagging machine, which determines where each product starts and finishes. This could be achieved through the use of a capacitive sensor under the conveyor, or through the use of a light beam which is broken as the products pass, or an electronic "eye" which senses the presence of a product for example. Other types of sensors could be used. By detecting the trailing edge of the second product to be packaged, the package can be sealed in close proximity to the second product, irrespective of the relative or cumulative lengths of the products. It is preferred that the wrapping or bagging machine is programmable to select the amount of spare packaging (or "tail") following the trailing product.

Further, the wrapping and sealing machine 140 or bagging machine is preferably also configured to provide the products in the package with predetermined spacing between the products. This can be achieved through the use of a sensor which determines the position of the trailing edge of the leading product and the position of the leading edge of the trailing product, and if that differs from the predetermined spacing then the relative positions of the products can be adjusted through the use of two conveyors which are individually controllable for example. It is preferred that the wrapping and sealing machine or bagging machine is programmable to select the predetermined spacing between the products in the package.

Figure 15:
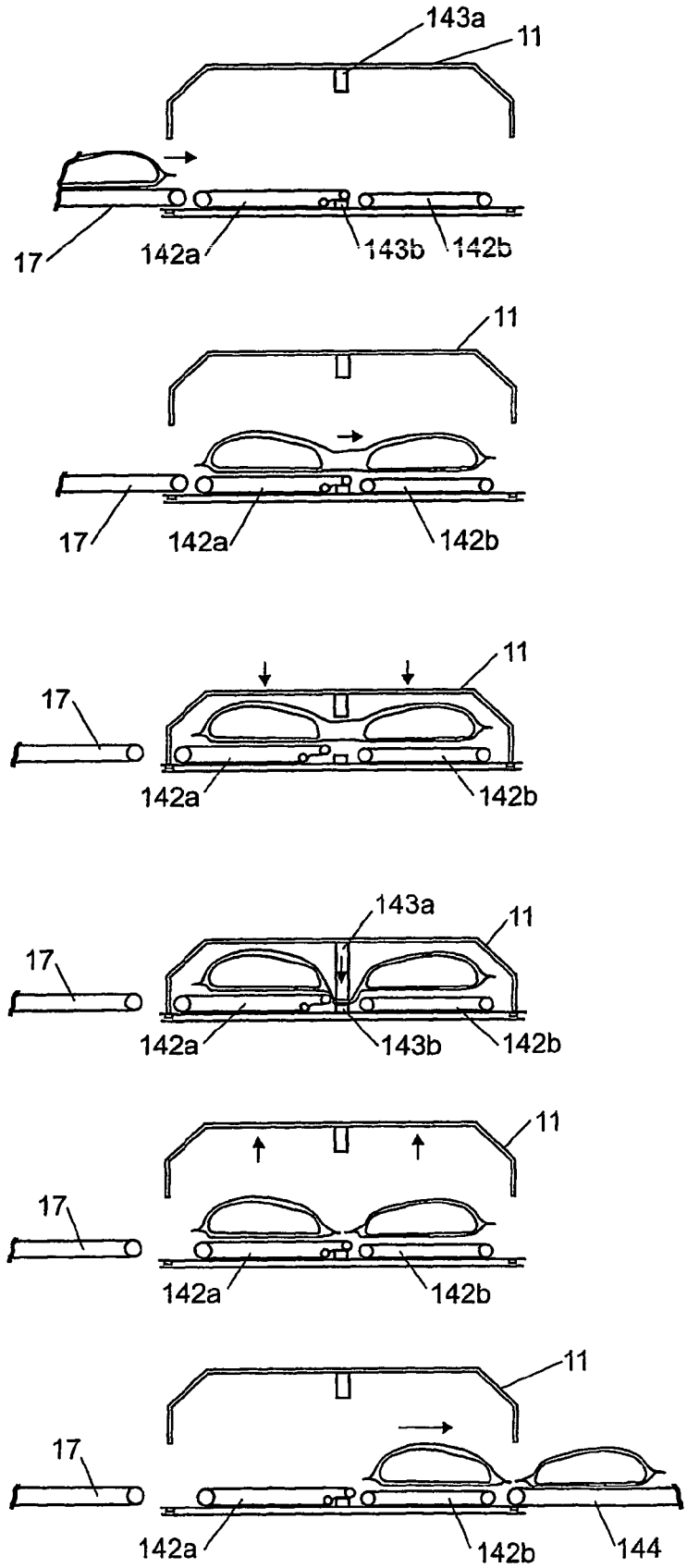
FIGS. 15 to 18 show possible arrangements of infeed, chamber, and outfeed conveyors for delivering packages into, positioning them in, and delivering packages from the vacuum packaging machine.

FIG. 15 shows one possible arrangement of infeed conveyor 17 and chamber conveyors 142 which operate to carry arriving packages into and position them in the vacuum chambers, before the vacuum hood 11 closes at the commencement of each evacuating and sealing operation. Chamber conveyors 142*a* and 142*b* are provided within the vacuum chamber(s). The forward end of conveyor 142*a* (right hand end in FIG. 15) can extend over the part 143*b* of sealing and cutting assembly 143 (part 143*b* typically being or including a heat seal anvil 21 referred to previously). In operation and referring to FIG. 15, a wrapped and sealed package containing the two meat cuts exiting the wrapping and packaging machine is carried by the infeed conveyor 17 towards the open vacuum chamber awaiting loading, as referred to previously. The infeed conveyor brings the product package to a position adjacent the vacuum chamber. The forward end of chamber conveyor 142*a* extends over the heat seal anvil or equivalent part 143*b* (step 1 in FIG. 15) and the package is carried by the moving infeed conveyor 17 and chamber conveyors 142*a* and 142*b* into the vacuum chamber until the package is positioned in the chamber with the spacing between products in the package is aligned with the sealing and cutting assembly within the vacuum chamber (step 2) when the chamber conveyors 142*a* and 142*b* stop the forward end of chamber conveyor 142*a* then retracts. The hood 11 of the vacuum chamber closes (step 3), then sealing and cutting assembly 143 operates to seal and cut between the two meat cuts in each package after evacuation to form two separate evacuated packages each containing a single meat cut (step 4), and the vacuum chamber then opens (step 5). At about the same time the forward end of chamber conveyor 142*a* re-extends over the lower part of the heat sealing and cutting assembly 143*b*, and the chamber conveyors 142*a* and 142*b* operate to deliver the two packages from the vacuum chamber, onto an outfeed conveyor 144 (step 6).

Figure 16:
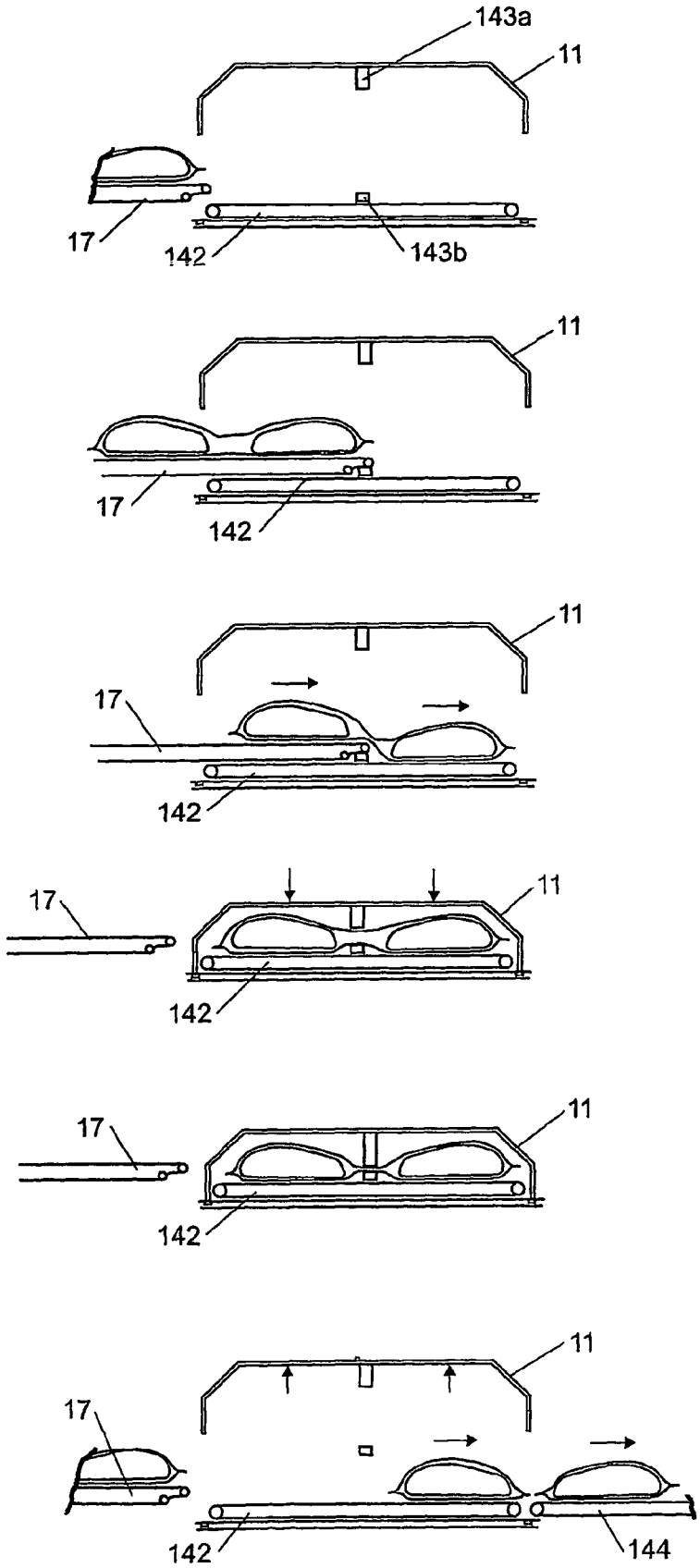

FIG. 16 shows another possible arrangement of conveyors for delivering packages into and positioning them in the vacuum chamber(s). In this arrangement infeed conveyor 17 has an extending forward end which enables the infeed conveyor 17 to not only bring the product package to a position adjacent the vacuum chamber, but to also extend into the open vacuum chamber and over the lower part eg heat seal anvil, of the sealing and cutting assembly 143 (see steps 2 and 3 in FIG. 16). In operation, infeed conveyor 17 carrying a package containing two meat cuts (step 1) extends into the interior of an open vacuum chamber awaiting loading, and the forward end of the infeed conveyor 17 extends over the lower part 143*b* eg heat seal anvil of the sealing and cutting assembly (step 2) while the infeed conveyor is operating to deliver the leading meat cut within the package onto the forward end of the chamber conveyor 142 (right hand end in FIG. 16—step 3). The infeed conveyor 17 then withdraws leaving the package containing the two meat cuts centrally on the chamber conveyor and the hood of the vacuum chamber closes (step 4). The sealing and cutting assembly 143 operates to seal and cut between the two meat cut products after evacuation to form two separate evacuated packages each containing a single meat cut (step 5) following which the vacuum chamber opens and the chamber conveyor 142 operates to deliver the two separate packaged meat cuts from the vacuum chamber and onto outfeed conveyor 144.

Figure 17:
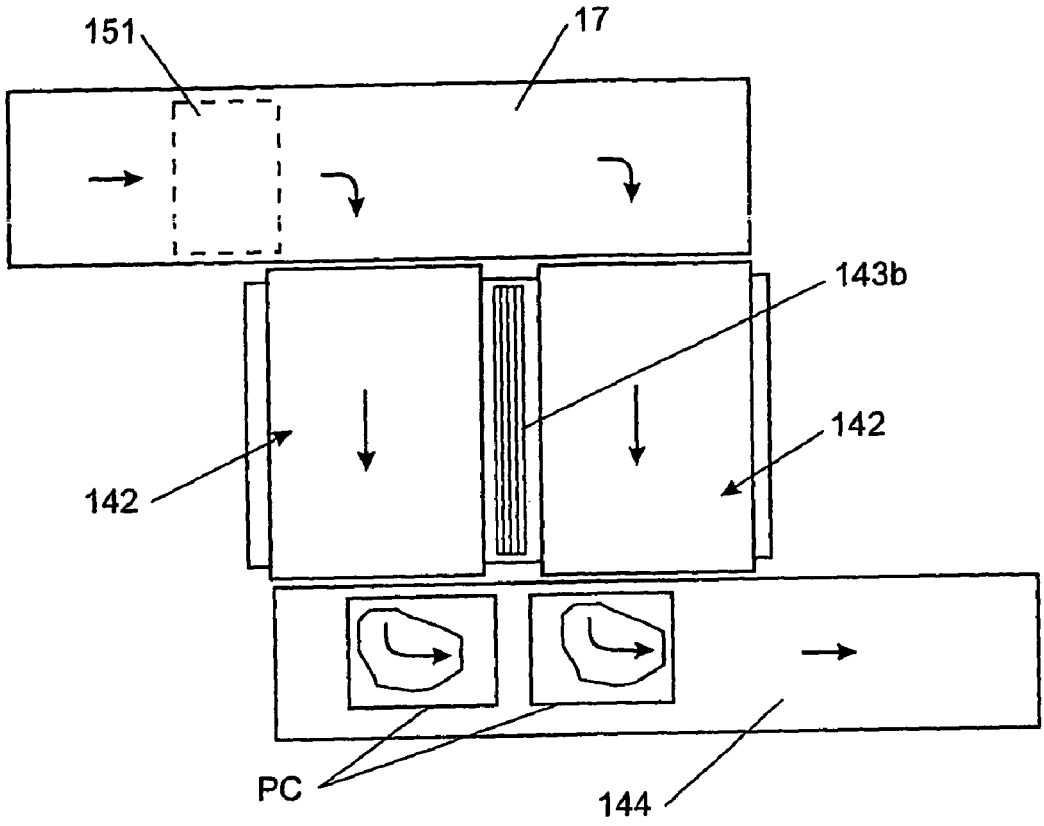
Figure 18:
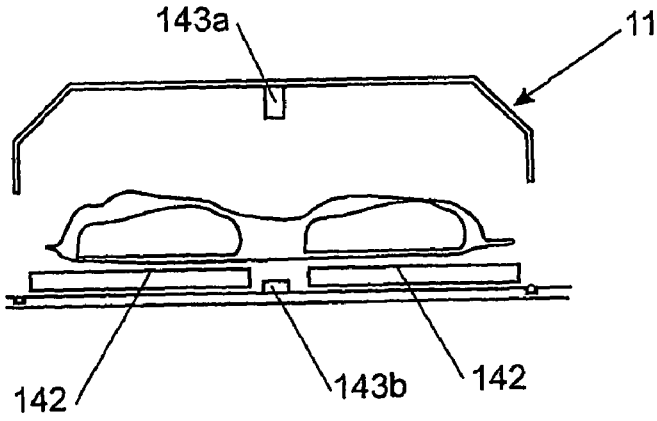

FIGS. 17 and 18 show an arrangement in which the direction of movement of chamber conveyors 142 is generally parallel to rather than across the sealing and cutting assembly 143. Infeed conveyor 17 delivers a sealed package containing two meat cuts to a position adjacent the vacuum chamber and chamber conveyors 142 operate to pick up the package and load it into the vacuum chamber so that the centre part of the package is positioned across the lower part of the sealing and cutting assembly 143 which is typically a heat seal anvil as described (see FIG. 18). After evacuating, sealing and cutting, and opening of the chamber, chamber conveyors 142 operate again to deliver the two packages onto outfeed conveyor 144 (see packages PC in FIG. 17).

A number of alternative arrangements can be used for transferring the product package from the infeed conveyor 17 to the chamber conveyors 142 in the embodiment of FIGS. 17 and 18. For example, one or more pushers could be arranged and operable to push the product package from the infeed conveyor 17 to the chamber conveyors, the chamber conveyors 142 could be arranged to extend out from the vacuum chamber to pick the product package up off the infeed conveyor, or a transverse indexing conveyor could be arranged to move with the infeed conveyor. These are options only, and other alternatives could be used.

The arrangements of conveyors for delivering packages into and positioning them in the vacuum chambers shown in FIGS. 15 to 18 are described by way of example only, and other arrangements may be possible.

It will be noted that in all of the conveyor arrangements shown in FIGS. 15 to 18, the sealing and cutting assembly is substantially transverse to the longitudinal direction of the infeed conveyor which brings the product packages to a position adjacent the vacuum chamber. The product packages are positioned on the infeed conveyor with the products one after the other with respect to the longitudinal direction of the infeed conveyor. Operation of the infeed conveyor is preferably indexed so that the spacing between the products within the package is aligned with the position of the transverse cutting and sealing assembly prior to the vacuum sealing operation. This is particularly useful when a package includes two products of different sizes or lengths, as the system can be configured to align the spacing between the two products of different sizes or lengths with the sealing and cutting assembly.

The indexing of the products relative to the sealing and cutting assembly will generally be achieved by providing a sensor upstream of the vacuum chamber. The sensor may be configured for example to detect the leading and trailing edges of the first product and the leading and trailing edges of the second product. Such a sensor 151 is shown schematically in FIG. 17. By determining at least the trailing edge of the first product package, the system can determine, from the speed of the conveyor, when to stop operation of the conveyor to align the spacing between the products in the package with the sealing and cutting assembly. It can do this irrespective of the relative lengths or sizes of the first and second products in the package. If the sensor is configured to detect the trailing edge of the first product and the leading edge of the second product, when a larger gap is provided between the products in the package, that can be located centrally on the lower part of the heat sealing and cutting assembly. Similar configurations could be used in the embodiments of FIGS. 15 and 16. In the embodiment of FIG. 15 for example, the trailing edge of the leading product could be detected on the infeed conveyor, and the speed of and duration of operation of the infeed conveyor and the chamber conveyors 142*a*, 142*b* could be controlled accordingly.

The preferred embodiment vacuum packaging machine of FIG. 14 is arranged to seal and cut centrally between two products in a single package, to form two separate packages, but a larger vacuum packaging machine may have two or more spaced sealing and cutting assemblies similar to those 143 in each vacuum chamber and be arranged to seal and cut one long package containing three or more products, into three or more separate sealed and evacuated packages. Also a machine similar to that of FIG. 14 may be arranged to form a central seal across a package between two products or more on either side, to form two sealed and evacuated packages, each containing two or more products.

Figure 19:
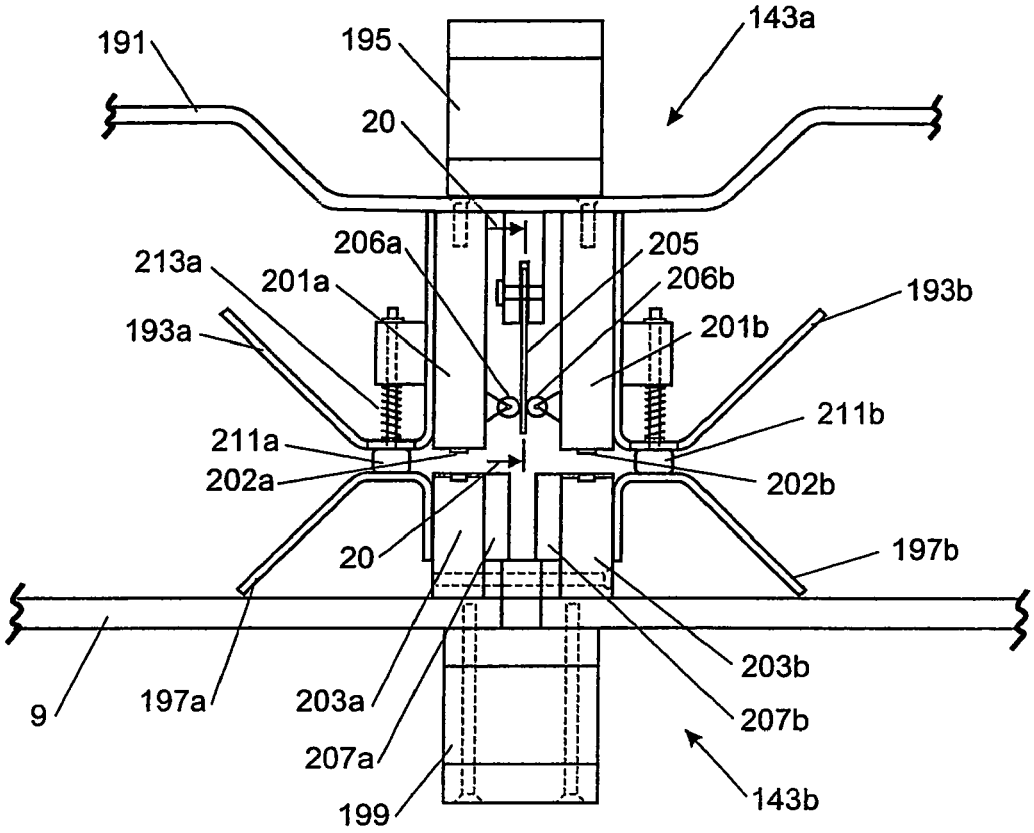
FIG. 19 shows a preferred sealing and cutting assembly for use in the vacuum packaging machine of FIGS. 14 to 18.
Figure 20:
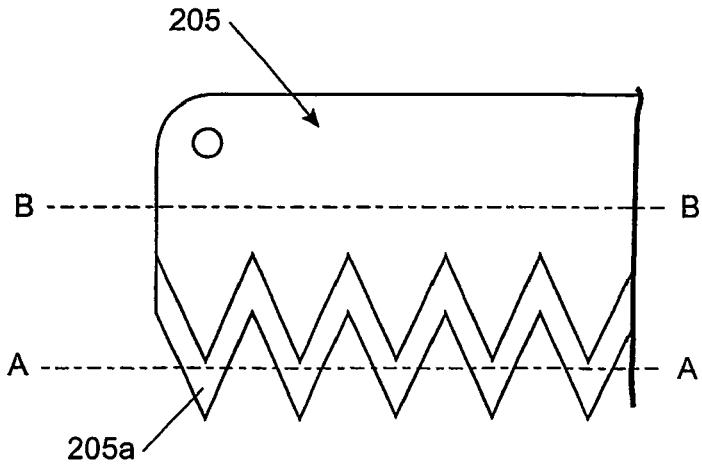
FIG. 20 is a part view of a blade along line 20-20 of FIG. 19.

Details of a preferred sealing and cutting assembly for the embodiments of FIGS. 14 to 18 are shown in FIGS. 19 and 20. The sealing and cutting assembly has an upper part 143*a* and a lower part 143*b*. A main support bar 191 in the upper part 143*a* supports a pair of support members 193*a*, 193*b*, as well as a heat seal bar drive mechanism 195. The main support bar 191 is configured to move with the vacuum chamber hood. A pair of spaced heat seal bars 201*a*, 201*b*, each of which includes a heat seal wire 202*a*, 202*b*, is operably connected to the heat seal drive mechanism 195.

The lower part 143*b* has a pair of support members 197*a*, 197*b* and an anvil drive mechanism 199 connected to the platen 9. A pair of heat seal anvils 203*a*, 203*b* corresponding to the neat seal bars 201*a*, 201*b* of the upper part, is operably connected to the anvil drive mechanism 199.

A cutting blade 205 is carried by the upper part, and is movable relative to the main support bar and is driven by a cutting blade drive mechanism, which may be part of the heat seal bar drive mechanism. A pair of rollers 206*a*, 206*b* allows movement of the cutting blade while maintaining its alignment A pair of supports 207*a*, 207*b* is located in the lower part 143*b* to provide support to a package during cutting.

Rather than using the spreaders described above, in this embodiment an alternative clamping arrangement is provided. A pair of pushers 211*a*, 211*b* is mounted on the upper support members 193*a*, 193*b*. The pushers 211*a*, 211*b* are biased downwardly by biasing means such as compression springs 213*a*, 213*b*. When the vacuum chamber is closed, the pushers engage against the lower support members 197*a*, 197*b*, to clamp the product package (not shown) therebetween.

During operation, once the product package has been loaded into the vacuum chamber such that one product is positioned in front of the sealing assembly (ie the left side of FIG. 19) and another product is positioned behind the sealing assembly (ie the right side of FIG. 19), the vacuum chamber is closed, which causes the upper part 143*a* of the sealing and cutting assembly to move towards the lower part of the sealing and cutting assembly 143*b*. During that movement, the portion of the product package between the two products is clamped between the pushers 211*a*, 211*b* and the respective lower support members 197*a*, 197*b*.

The cutting blade is then moved downwardly relative to the upper support members 193*a*, 193*b* to pierce the package to approximately line A-A shown in FIG. 20. Support is provided for the part of the package being pierced by supports 207*a*, 207*b*. This operation provides pierced apertures in the package through which gas can be evacuated from inside the package.

The vacuum chamber is then evacuated, thereby evacuating any air from the package through its pierced apertures.

The heat seal anvil bars 201*a*, 201*b* and anvils 203*a*, 203*b* are then moved towards one another to engage the package therebetween, and current is passed through the heat seal wires 202*a*, 202*b*, thereby forming a pair of spaced apart heat seals. The cutting blade then shears the portion of the product package between the heat seal bars 201*a*, 201*b* to form two separate evacuated product packages, by inserting the cutting blade into the package approximately to line B-B.

The anvils and heat seal bars are then separated, and when the chamber moves to the loading/unloading position and opens, the separate product packages will be released from between the pushers 211*a*, 211*b* and the lower supports 197*a*, 197*b*.

Modifications may be made to the heat seal assembly described with reference to FIGS. 19 and 20. For example, the heat seal anvils could be provided in the upper part of the sealing assembly with the heat seal bars provided in the lower part of the assembly. Further, the cutting device/blade could be provided in the lower part of the assembly. As another variant, spreaders such as those described above could be used instead of the pushers.

While specific embodiments of the invention have been described above, modifications may be made thereto without departing from the scope of the invention:

While the vacuum packaging machine shown in FIG. 14 includes two vertically-spaced vacuum chambers, it will be appreciated that three or more vacuum chambers may be provided. In addition or alternatively, the vacuum chambers could be horizontally spaced, or a three dimensional (vertical/horizontal) array of vacuum chambers may be provided While the embodiment of the machine shown in FIG. 14 has the vacuum chambers being vertically moveable, alternatively the infeed conveyor 17 and outfeed conveyor (not shown) could be vertically moveable and the vacuum chambers fixed. Further, more than one of each of the infeed and outfeed conveyors may be provided to provide a system having higher capacity.

While the preferred embodiment vacuum packaging machine has vertically moveable vacuum chambers, the invention also encompasses a single vacuum chamber machine or a machine having a number of vacuum chambers but which do not move in the way described. One or more stationary vacuum chambers may each incorporate one or more sealing and cutting assemblies similar to those 143 in each vacuum chamber, so that packaged products entering the vacuum chamber are evacuated, and sealed and cut into two or more separate sealed and evacuated packages, which are removed from or exit the stationary vacuum chamber at the completion of vacuum and seal operation.

A sealing and cutting assembly may also be incorporated in the vacuum chambers of a flat bed rotary vacuum machine or vertical (ferris wheel orientation) rotary machine, so that one package containing two or more products is entered into the vacuum chamber(s) of the rotary machine and evacuated and separated into two or more separate packages which exit the vacuum chamber on the outfeed conveyor from the rotary machine.

One advantage of the invention including the generally central sealing mechanism is that a range of sizes of packages sealed at both ends but of different lengths, in different production shifts or randomly in the same production shift, maybe evacuated and sealed centrally in the one vacuum packing machine. Another advantage is that scrap ie the portion of the product package which is cut off after evacuating and sealing one end of an open bag package, is avoided, which avoids material wastage. By having a sealing and cutting assembly oriented transversely to the infeed conveyor direction, packages containing products of different sizes can easily be sealed and separated by variably aligning the spacing between the products with the sealing and cutting assembly. This is important for reducing packaging material waste with products that vary in size, such as meat cuts.

The preferred embodiments described above load and seal one product package at a time. However, it will be appreciated that the infeed conveyor and vacuum chambers could be configured to load and vacuum seal two or more packages situated side-by-side.

The invention claimed is:

1. A vacuum packaging machine for performing a vacuum sealing operation on a product package containing two or more products, comprising:

a) an in-feed conveyor; and b) a vacuum chamber;

the in-feed conveyor arranged to deliver the product package from an upstream station to a position adjacent the vacuum chamber, and having a longitudinal direction defined by the direction of travel of the product package on the in-feed conveyor;

the vacuum chamber arranged to receive the product package containing two or more products and perform a vacuum, sealing and cutting operation on the product package, the vacuum chamber comprising a) a heat sealing and cutting assembly, and b) end walls;

the heat sealing and cutting assembly being oriented transversely to the longitudinal direction of the in-feed conveyor, and located in a position in the vacuum chamber such that there is sufficient spacing between the end walls of the vacuum chamber and the heat sealing and cutting assembly for the product package containing two or more products to be loaded into the vacuum chamber with at least one product located in front of the heat sealing and cutting assembly and at least one other product located behind the heat sealing and cutting assembly, the heat sealing and cutting assembly arranged to seal and cut across the product package between two products to form two separate evacuated packages;

wherein the vacuum packaging machine comprises one or more chamber conveyors, the one or more chamber conveyors being separate from the in-feed conveyor, disposed in the vacuum chamber, for receiving the product package into the vacuum chamber and/or conveying the product package from the vacuum chamber following the vacuum, sealing and cutting operation.

2. The vacuum packaging machine of claim 1, wherein the heat sealing and cutting assembly comprises a pair of heat seal bars.

3. The vacuum packaging machine of claim 1, wherein the heat sealing and cutting assembly comprises a pair of heat seal anvils.

4. The vacuum packaging machine of claim 1, wherein the heat sealing and cutting assembly comprises a cutting device which is operable to cut the product package after sealing, to thereby form two separate evacuated packages.

5. The vacuum packaging machine of claim 1, wherein the heat sealing and cutting assembly is configured to form two heat seal lines between the two products and then cut between the two heat seal lines to form two separate evacuated packages, following evacuation of the product package.

6. The vacuum packaging machine of claim 1, comprising an arrangement to clamp the portion of the package to be sealed, prior to sealing and cutting the package.

7. The vacuum packaging machine of claim 1, comprising a puncturing device which is operable to puncture at least one aperture in the portion of the product package adjacent the sealing and cutting assembly so that as the vacuum and sealing operation occurs, air is evacuated from the package through the at least one aperture prior to heat sealing.

8. The vacuum packaging machine of claim 1, arranged to receive, seal and separate a package having at least one unsealed portion and containing at least two products, into individual product packages, and comprising at least one further heat sealing assembly spaced from the heat sealing and cutting assembly and configured to seal the at least one unsealed portion of the package after evacuation while the heat sealing and cutting assembly carries out the sealing and cutting operation across the product package between two products to form two individual product packages.

9. The vacuum packaging machine of claim 1, wherein the in-feed conveyor is configured to deliver the product package directly into the vacuum chamber in the longitudinal direction.

10. The vacuum packaging machine of claim 1, wherein the in-feed conveyor is arranged to deliver the product package to a position alongside the vacuum chamber, and comprising a further conveyor configured to load the product package from the conveyor into the vacuum chamber in a transverse direction.

11. The vacuum packaging machine of claim 1, which is indexed to align the portion of the product package between the two products with the heat sealing and cutting assembly.

12. The vacuum packaging machine of claim 1, comprising a sensor, disposed above the in-feed conveyor, and upstream of the vacuum chamber, to sense the trailing edge of a leading product and/or a leading edge of a trailing product in the product package on the in-feed conveyor.

13. The vacuum packaging machine of claim 1, wherein the vacuum packaging machine is configured to load and unload product packages concurrently.

14. The vacuum packaging machine of claim 1, in combination with a wrapping or bagging machine, disposed upstream of the vacuum chamber, arranged to load at least two products into each product package to be sealed in the vacuum packaging machine.

15. The combination of claim 14, wherein the wrapping or bagging machine is configured to position the products in each product package with a predetermined spacing.

16. The combination of claim 14, wherein the wrapping or bagging machine is programmable to vary the product package size or predetermined spacing.

17. The vacuum packaging machine of claim 1, wherein the product package is in the form of a single sealed bag having two products therein, the products spaced apart from each other.

* * * * *